US012082697B1

(12) United States Patent
Tang et al.

(10) Patent No.: US 12,082,697 B1
(45) Date of Patent: Sep. 10, 2024

(54) POWERED LIFTING TABLE

(71) Applicant: MARINA TF PTE. LTD., Singapore (SG)

(72) Inventors: Yongfei Tang, Shanghai (CN); Yulu Zheng, Shanghai (CN)

(73) Assignee: MARINA TF PTE. LTD., Singapore (SG)

( * ) Notice: Subject to any disclaimer, the term of this patent is extended or adjusted under 35 U.S.C. 154(b) by 0 days.

(21) Appl. No.: 18/407,089

(22) Filed: Jan. 8, 2024

(51) Int. Cl.
*A47B 9/20* (2006.01)
*A47B 21/02* (2006.01)
*A47B 21/06* (2006.01)

(52) U.S. Cl.
CPC ..... *A47B 9/20* (2013.01); *A47B 21/02* (2013.01); *A47B 21/06* (2013.01); *A47B 2021/066* (2013.01); *A47B 2200/0052* (2013.01); *A47B 2200/008* (2013.01); *A47B 2220/003* (2013.01)

(58) Field of Classification Search
CPC ..... A47B 9/20; A47B 21/02; A47B 21/04; A47B 21/06; A47B 2021/066
USPC ..... 108/50.02, 147.19; 248/188.4
See application file for complete search history.

(56) References Cited

U.S. PATENT DOCUMENTS 9,629,452 B1 * 4/2017 Chen ..... A47B 9/20
10,107,448 B1 * 10/2018 Hung ..... A47B 9/20
10,226,119 B1 * 3/2019 Ko ..... A47B 9/20
10,631,631 B1 * 4/2020 Pei ..... B66F 3/247
10,912,380 B1 * 2/2021 Lu ..... G01P 13/00
2014/0360415 A1 * 12/2014 Riis ..... A47B 9/20 248/354.1
2015/0108297 A1 * 4/2015 Randlov ..... A47B 9/20 248/188.4
2015/0320213 A1 * 11/2015 Sorrell ..... A47B 9/04 108/147.19
2016/0032953 A1 * 2/2016 Papadopoulos ..... F16M 11/26 248/188.4
2016/0170402 A1 * 6/2016 Lindström ..... A47B 9/00 700/275
2016/0281912 A1 * 9/2016 Christen ..... F16B 7/10
2018/0090915 A1 * 3/2018 Byrne ..... H02B 1/06
2018/0092457 A1 * 4/2018 Lai ..... A47B 9/20
2018/0202476 A1 * 7/2018 Wu ..... A47B 9/20
2019/0125074 A1 * 5/2019 Cheng ..... H02M 3/137
2019/0261778 A1 * 8/2019 Lukas ..... G01S 7/497
2020/0132116 A1 * 4/2020 Walling ..... F16C 29/02
2020/0196747 A1 * 6/2020 Lu ..... A47B 9/00
2021/0052066 A1 * 2/2021 Wu ..... F16B 7/10
2021/0100353 A1 * 4/2021 Olesen ..... A47B 9/20
2021/0106133 A1 * 4/2021 Anderson ..... A47B 21/06

(Continued)

FOREIGN PATENT DOCUMENTS

CN 215649739 U 1/2022
CN 217771744 U 11/2022

(Continued)

*Primary Examiner* — Jose V Chen
(74) *Attorney, Agent, or Firm* — Polygon IP, LLP

(57) ABSTRACT

Various configurations and systems for lifting tables are provided. The lifting tables may include legs that are extendable and retractable. The legs may include various components, such as L-shaped internal brackets configured to hold lubricants to provide for smooth lifting operations, cable management configurations, and/or other features to improve the operation of a lifting table.

16 Claims, 28 Drawing Sheets

(56) References Cited

U.S. PATENT DOCUMENTS

| | | | | |
|---|---|---|---|---|
| 2021/0227970 | A1* | 7/2021 | Randløv | A47B 9/20 |
| 2021/0393027 | A1* | 12/2021 | Udagawa | A47B 21/06 |

FOREIGN PATENT DOCUMENTS

| | | | |
|---|---|---|---|
| CN | 217771755 | U | 11/2022 |
| CN | 219661177 | U | 9/2023 |

* cited by examiner

POWERED LIFTING TABLE

FIELD OF TECHNOLOGY

This patent application relates generally to tables, and more specifically to lifting tables with power and data connections.

BACKGROUND

The advancement of technology has resulted in increased use of computers by people for their daily lives. People depend on desks for housing their computers and organizing their personal or work items, resulting in desks becoming an increasingly important element of people's lives. Basic advancements for desks have followed, such as lifting tables, but the desk or table design have failed to keep pace with the advancement of electronics.

SUMMARY

Described herein are systems and techniques for lifting tables. In a certain embodiment, a lifting table may be disclosed. The lifting table comprising: a tabletop; and a lifting leg, coupled to the tabletop and configured to dispose the tabletop within a plurality of different heights, the lifting leg comprising: a first leg element; a second leg element, wherein at least a portion of the second leg element is disposed within the first leg element, and wherein the second leg element is configured to move relative to the first leg element; and a L-shaped bracket, disposed between the first leg element and the second leg element, coupled to one of the first leg element or the second leg element, and configured to move relative to the other of the first leg element or the second leg element.

In another embodiment, a lifting table may be disclosed. The lifting table comprising: a tabletop; and a lifting leg, coupled to the tabletop and configured to dispose the tabletop within a plurality of different heights, the lifting leg comprising: an outer leg; and a lift mechanism, at least partially disposed within the outer leg, the lift mechanism comprising: a screwblock, comprising a threaded portion; an adjustment screw, threaded into the threaded portion of the screwblock and configured to move a position of the screwblock relative to the outer leg when the adjustment screw is rotated; and a table foot, coupled to the screwblock and configured to move vertically in response to movement of the screwblock.

In a further embodiment, a lifting table may be disclosed. The lifting table comprising: a tabletop; and a lifting leg, coupled to the tabletop and configured to dispose the tabletop within a plurality of different heights, the lifting leg comprising: a first leg element; a second leg element, wherein at least a portion of the second leg element is disposed within the first leg element, and wherein the second leg element is configured to move relative to the first leg element; a lifting mechanism, disposed within the first leg element and the second leg element; a power and/or data port; a cable, disposed within the first leg element and the second leg element and electrically coupled to the power and/or data port; and a shield, disposed proximate at least a portion of the cable and between at least a portion of the lifting mechanism and the portion of the cable.

These and other embodiments are described further below with reference to the figures.

BRIEF DESCRIPTION OF THE DRAWINGS

The included drawings are for illustrative purposes and serve only to provide examples of possible structures and operations for the disclosed inventive systems, apparatus, and methods for lifting tables. These drawings in no way limit any changes in form and detail that may be made by one skilled in the art without departing from the spirit and scope of the disclosed implementations.

DETAILED DESCRIPTION

In the following description, numerous specific details are outlined to provide a thorough understanding of the presented concepts. The presented concepts may be practiced without some or all of these specific details. In other instances, well-known process operations have not been described in detail to not unnecessarily obscure the described concepts. While some concepts will be described in conjunction with the specific embodiments, it will be understood that these embodiments are not intended to be limiting.

In the following description, various techniques and mechanisms may have been described in singular form for clarity. However, it should be noted that some embodiments include multiple iterations of a technique or multiple instantiations of a mechanism unless otherwise noted. For example, a table leg may be described with a cable, but can include a plurality of cables while remaining within the scope of the present disclosure unless otherwise noted. Similarly, various techniques and mechanisms may have been described as including a connection between two entities. However, a connection does not necessarily mean a direct, unimpeded connection, as a variety of other entities (e.g., fasteners, spacers, fittings etc.) may reside between the two entities.

For the purposes of this disclosure, reference may be made to directions such as "horizontally" and "vertically." It is appreciated that such terms refer to the ordinary usage with respect to tables. Accordingly, "horizontally" refers to geometry that is substantially (e.g., +/−5 degrees) parallel to the plane of the tabletop while "vertically" refers to planes that are normal to the plane of the tabletop.

INTRODUCTION

Described herein are systems and techniques for lifting tables. As used herein, "tables" may refer to traditional tables such as dining tables, desks, portable tables, work benches, coffee tables, and/or any other structure for supporting items. As described herein, such lifting tables may be configured to be adjustable in height. Height adjustments may allow for the table to be disposed in one of a plurality of different height settings and/or may be continuously adjusted along an adjustment range. Various features of lifting tables may be described.

Lifting Tables

Figure 1:
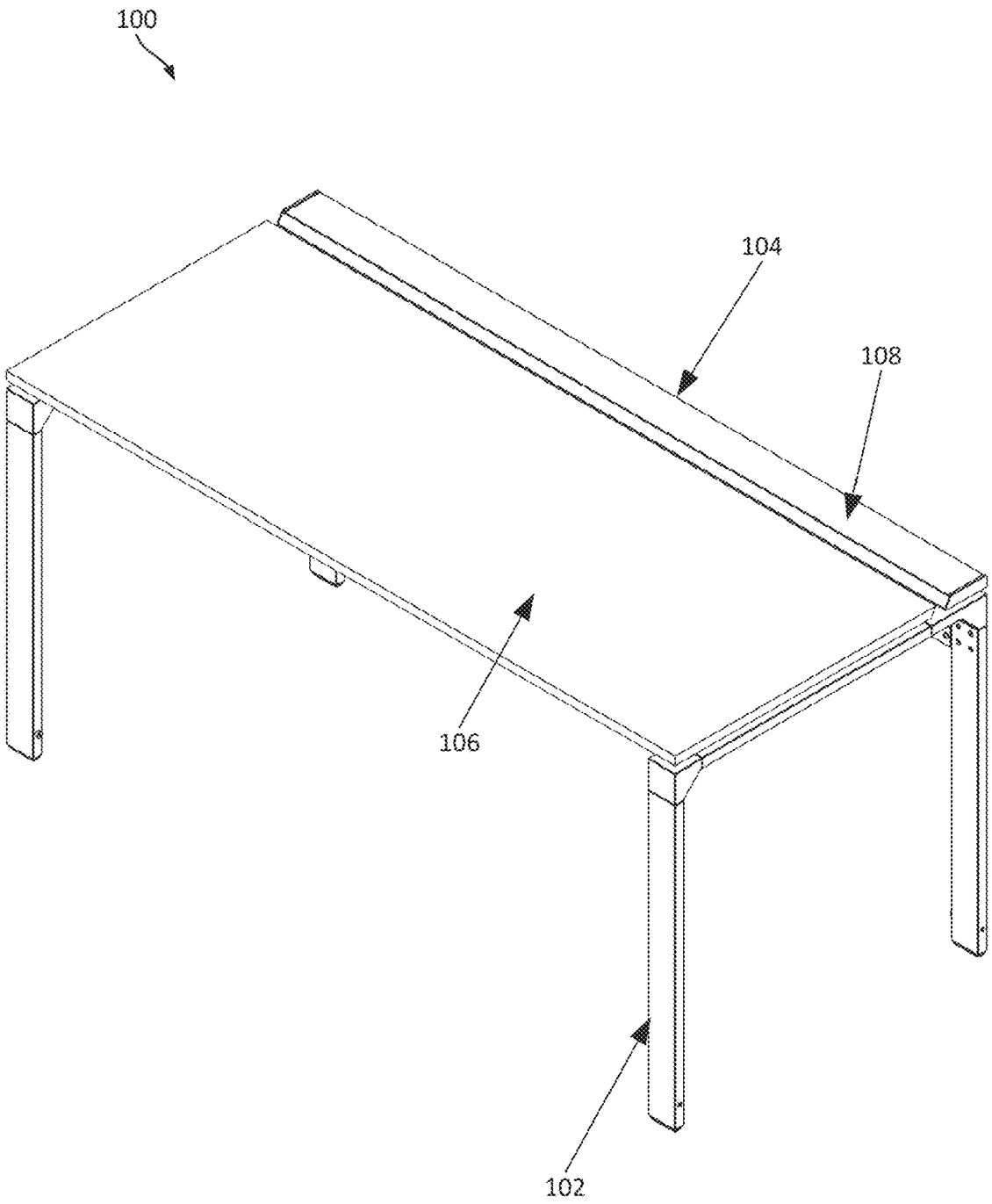
FIGS. 1 and 2 illustrate various embodiments of a lifting table, in accordance with certain embodiments.
Figure 2:
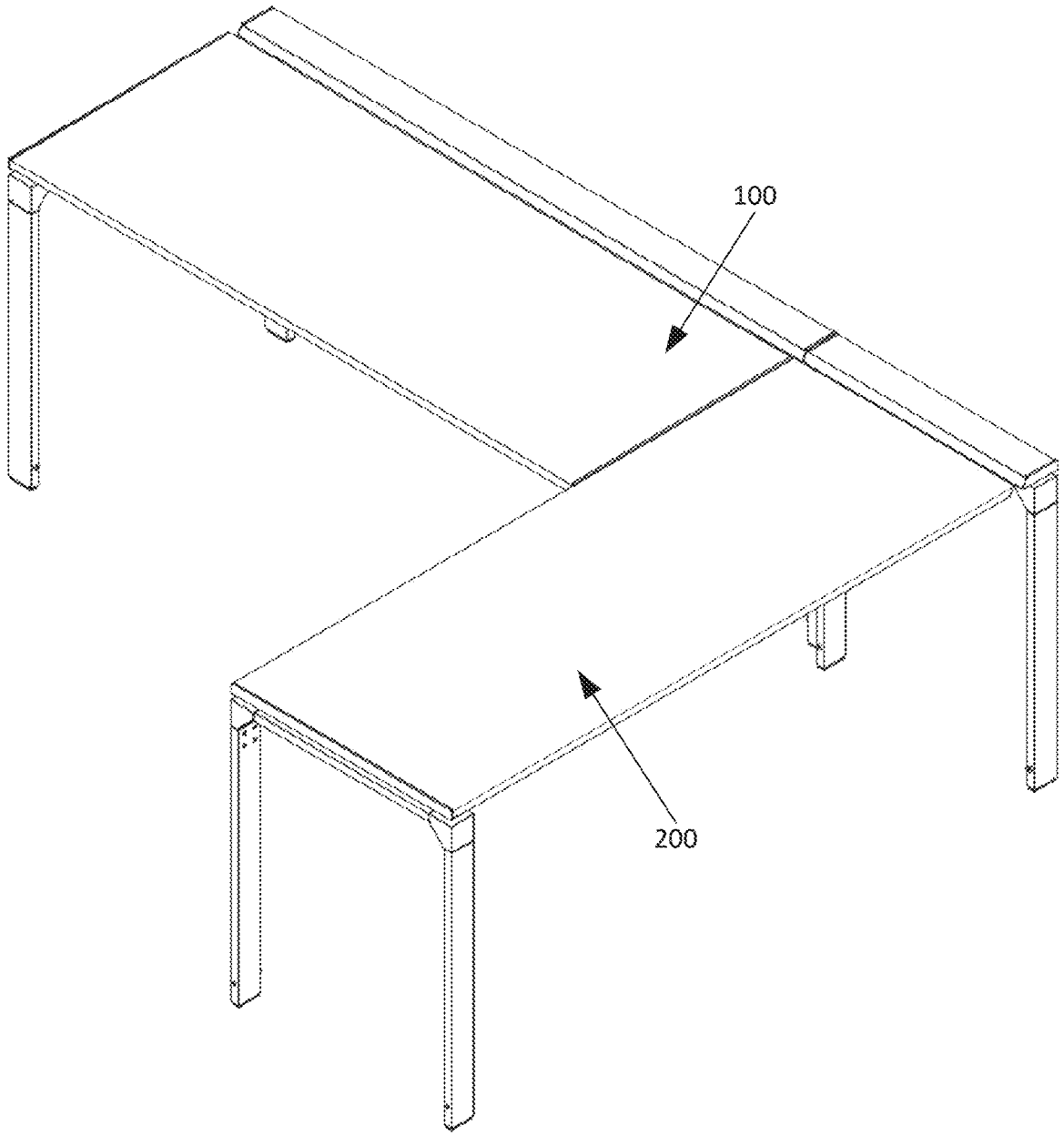

FIGS. 1 and 2 illustrate various embodiments of a lifting table, in accordance with certain embodiments. FIG. 1 illustrates table 100 that includes leg 102 and tabletop 104. Tabletop 104 may be a tabletop configured to support the weight of items placed on top of tabletop 104. In certain embodiments, table 100 may be, for example, a gaming table or other such table or desk.

Tabletop 104 may be a one-piece tabletop or may include a plurality of portions, such as first tabletop portion 106 and second tabletop portion 108. In certain such embodiments, one or more of the plurality of portions may be moveable. That is, for example, first tabletop portion 106 and/or second tabletop portion 108 may be configured to rotate to allow for reconfiguring of table 100 and/or for access or storage, such as to access power and/or network outlets.

In certain such embodiments, tabletop 104 may be of various different structures. For example, one or more portions of tabletop 104 (e.g., first tabletop portion 106 and/or second tabletop portion 108) may be made from a combination wooden board, iron/magnetic powder, and/or welt (e.g., fireproof welt). Such a configuration may allow for a tabletop that provides the aesthetics of a wooden tabletop while being magnetic. In such embodiments, the iron/magnetic powder may be infused within the wooden board and the welt may be utilized as trim along the side of the wooden board.

In certain embodiments, table 100 may be configured to be disposed alongside another table, such as table 200 illustrated in FIG. 2, to provide for a different configuration working surface. Combination of table 100 and table 200 may allow for a L-shaped working surface to be formed, increasing the work space and flexibility of a desk configuration.

In various embodiments, leg 102 may be a lifting leg and may be adjustable in height. In certain embodiments, table 100 may include a plurality of leg 102*s* and such leg 102*s* may be independently adjustable and/or adjustable in concert (e.g., via interconnected mechanical systems such as a gear, belt, or chain drive operating off of a single motor and/or via software such as through a controller providing instructions in concert to a plurality of different electric motors) with one or more other legs. The lifting mechanism of leg 102 may be further described in FIGS. 3-5.

Figure 3:
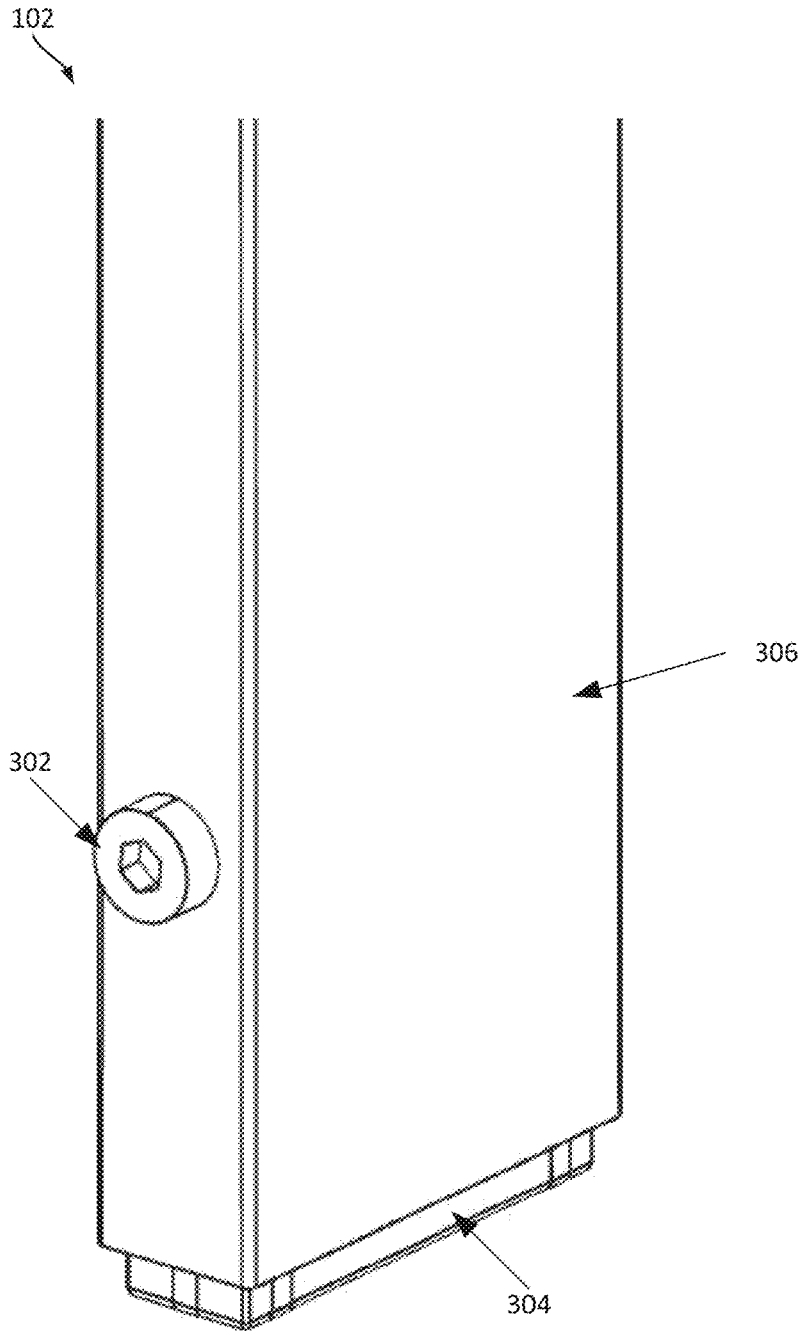
FIGS. 3-5 illustrate a lifting mechanism of the lifting table, in accordance with certain embodiments.
Figure 4:
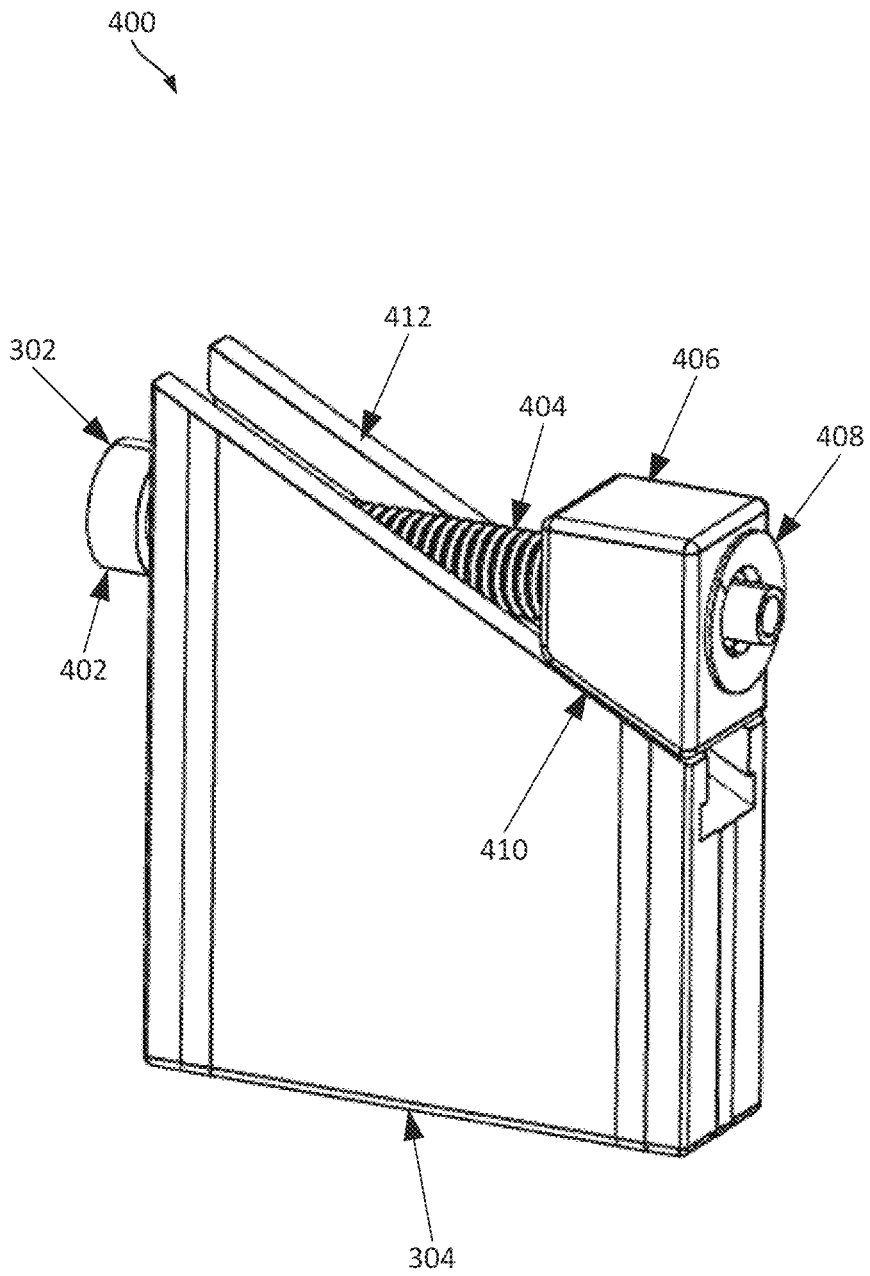
Figure 5:
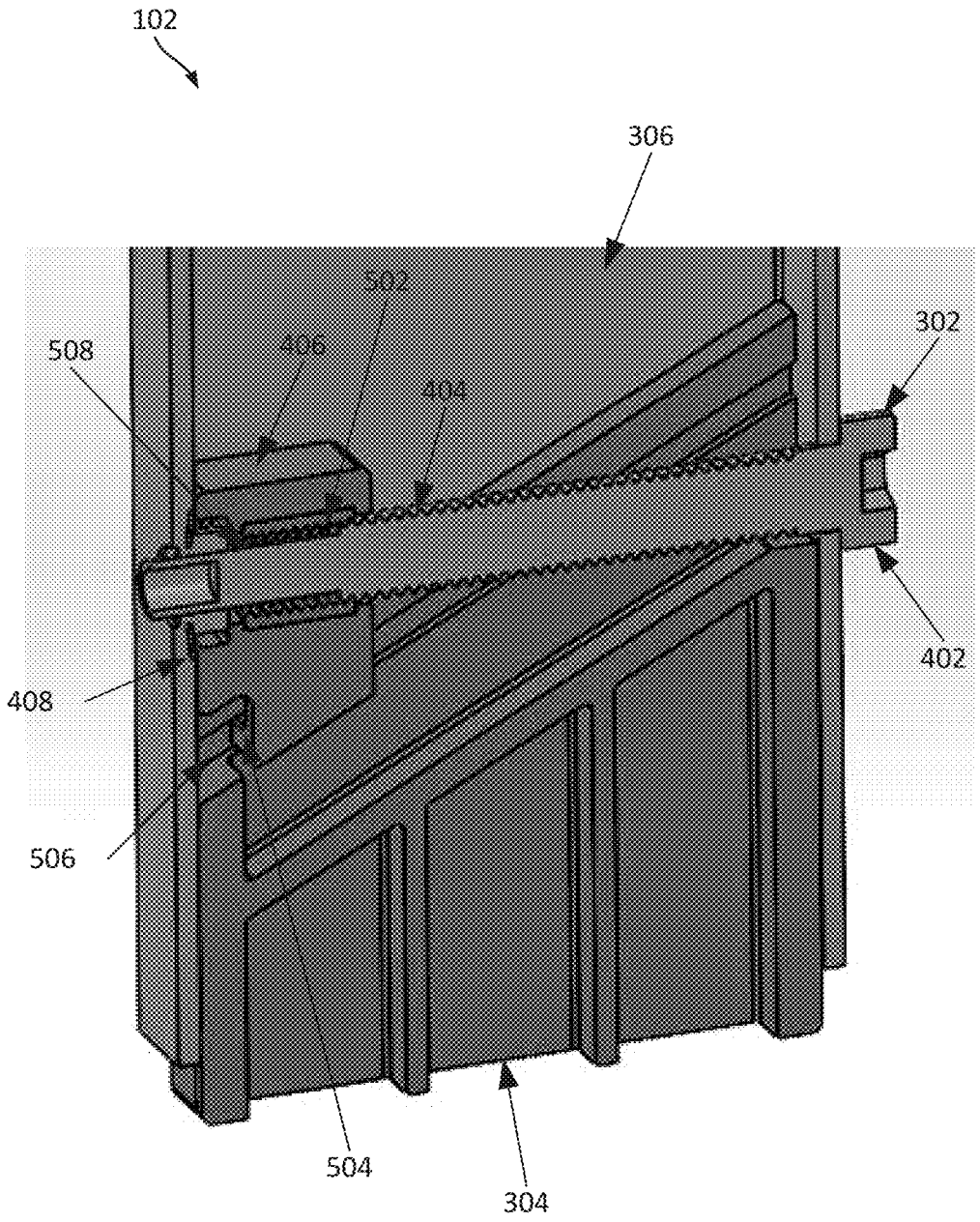

FIGS. 3-5 illustrate a lifting mechanism of the lifting table, in accordance with certain embodiments. FIGS. 3-5 illustrate the lifting mechanism of leg 102, where the position of table foot 304 relative to outer leg 306 is adjusted via adjustment screw 302. Outer leg 306 may be the outer covering (e.g., a wooden, metal, or other skin) of leg 102. A user may rotate adjustment screw 302 to raise or lower table foot 304, depending on the direction of rotation, relative to table foot 304 to adjust the height of the lifting table. In various embodiments, the range of adjustment may be, for example, between 100 to 1,000 millimeters.

FIG. 4 illustrates lift mechanism 400, which is used to lift table foot 304 of leg 102. Lift mechanism 400 includes adjustment screw 302, table foot 304, screwblock 406, and spring 408. Screwblock 406 includes a female threaded portion and adjustment screw 302 includes screwhead 402 and threaded portion 404. Threaded portion 404 may be configured to be threaded into the female threaded portion of screwblock 406. In certain embodiments, adjustment screw 302 may be captive relative to outer leg 306. That is, rotation of adjustment screw 302 may not result in substantial translation of the position of adjustment screw 302 relative to outer leg 306.

In certain embodiments, table foot 304 and/or screwblock 406 may include one of more surfaces that are angled relative to horizontal. For example, table foot 304 may include angled surface 412 and screwblock 406 may include corresponding angled surface 410. Rotation of adjustment screw 302 may cause screwblock 406 to translate (e.g., translate horizontally). Interaction between the one or more angled surfaces of table foot 304 and/or screwblock 406 (e.g., between angled surface 412 and angled surface 410) may then cause upward or downward movement of table foot 304, depending on the direction of rotation of adjustment screw 302. Thus, for example, rotation of adjustment screw 302 that results in screwblock 406 moving towards screwhead 402 (e.g., due to threaded portion 404 and internal threading 502 of screwblock 406, shown in FIG. 5) may result in downward movement of table foot 304 relative to the vertical position of adjustment screw 302. Downward movement of table foot 304 may extend the length of leg 102. Conversely, rotation of adjustment screw 302 that results in screwblock 406 moving away from screwhead 402 may result in upward movement of table foot 304 relative to the vertical position of adjustment screw 302 and, thus, shorten the length of leg 102.

In another embodiment, screwblock 406 may include angled tongue 504 that is inserted into angled groove 506 of table foot 304. Angled tongue 504 may extend from a top portion, bottom portion, from one or more side, and/or another portion of screwblock 406. Angled groove 506 may be disposed within an internal (e.g., inside a cavity), external (e.g., along the outside surface), and/or another portion of table foot 304. Additional embodiments may dispose one or more angled grooves on the screwblock and one or more angled tongues on the table foot.

Similar to angled surface 410 and angled surface 412, angled tongue 504 and/or groove angled 506 may include one of more surfaces that are angled relative to horizontal. Rotation of adjustment screw 302 may thus, result in movement of screwblock 406 towards or away from screwhead 402, resulting in downward or upward movement, respectively, of table foot 304. Other embodiments may be configured so that rotation of adjustment screw 302 may result in different directions of movement of screwblock 406 and/or table foot 304.

In certain embodiments, spring 408 may be a spring such as a disc-shaped spring (e.g., Belleville washer) or other such spring that may provide a spring force against screwblock 406. In certain embodiments, adjustment screw 302 may include unthreaded portion 508. Without the spring force provided by spring 408, screwblock 406 at the limit of travel (e.g., when screwblock 406 is abutted against the inner wall of outer leg 306 at the position farthest away from screwhead 402) may exert a force against adjustment screw 302 that may result in adjustment screw 302 breaking free of its captive features. In a certain embodiment, adjustment screw 302 may include unthreaded portion 508 that allows for threaded portion 404 of adjustment screw 302 to disengage from internal threading 502 of screwblock 406 at screwblock 406's limit of travel. Spring 408 may then provide a force against screwblock 406 to cause internal threading 502 of screwblock 406 to reengage with threaded portion 404 when adjustment screw 302 is rotated in the opposite direction (e.g., the direction that pulls screwblock 406 towards screwhead 402).

Figure 6:
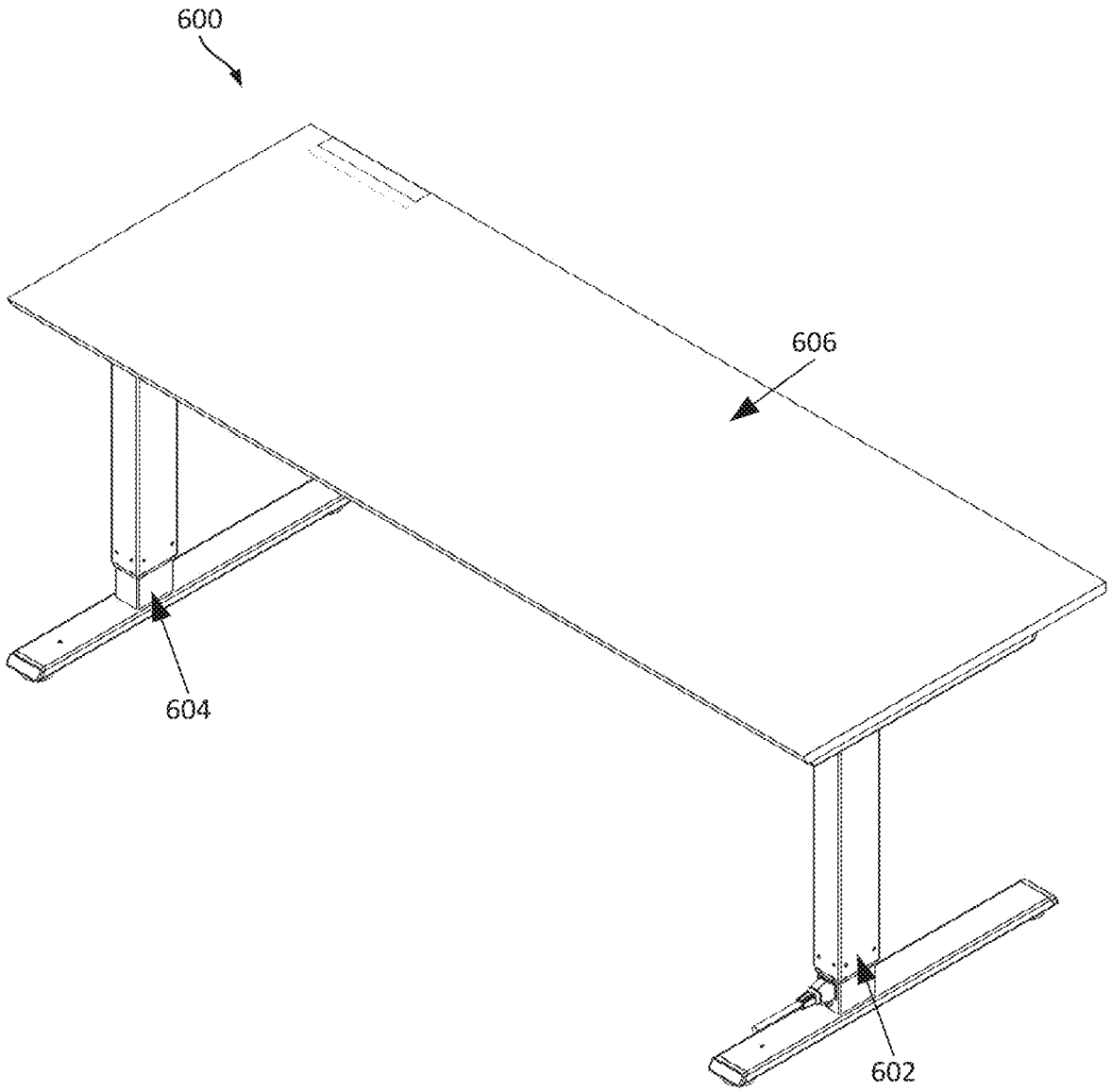
FIGS. 6 and 7 illustrate another embodiment of a lifting table, in accordance with certain embodiments.

FIG. 6 illustrates another embodiment of a lifting table, in accordance with certain embodiments. FIG. 6 illustrates table 600 that includes leg 602, leg 604, and tabletop 606. In certain embodiments, table 600 may be, for example, a work desk, gaming table, or other such table or desk. tabletop 606 may be a tabletop made from a combination wooden board, iron/magnetic powder, and/or welt (e.g., fireproof welt).

Figure 7:
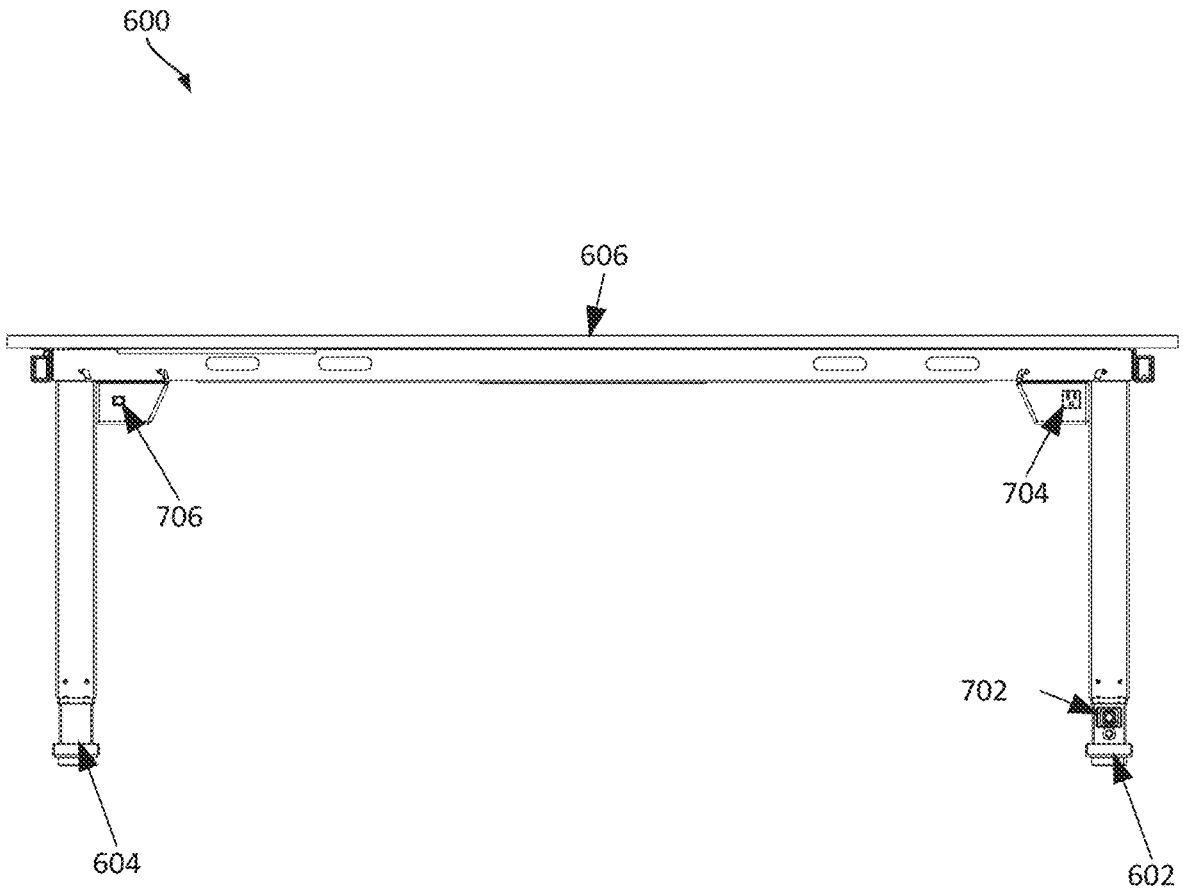

Leg 602 and leg 604 may include various power and/or data connections, as shown in FIG. 7. As shown in FIG. 7, leg 602 (e.g., the "right" leg) may include power port 702 and power port 704, which may be ports that are configured to receive and/or provide (e.g., may be male or female outlets) power providing connections such as direct current (e.g., Universal Serial Bus or USB, DC sockets, and/or other DC power outlets) and/or alternating current (120, 220, and/or other voltages) power connections. Power connections may be provided both at the bottom (near the feet) and the top of leg 602 for further convenience. Leg 602 may include other power ports that are not shown. Leg 604 (e.g., the "left" leg) may include data connection 706, which may be a data or network port such as an RJ port, telephone jack, USB port, and/or another such port (e.g., microphone jack) configured to receive a connection that may be configured to receive or provide data. Leg 604 may include other data ports that are not shown. In certain embodiments data connection 706 may include a retractable network cable (e.g., a CAT6 cable) installed within leg 604 additional or alternative to network cable connection sockets (e.g., RJ45 sockets).

Legs 602 and 604 may be configured to change in length. That is, legs 602 and 604 may be continuously adjustable or adjustable between a plurality of positions within a range of adjustment. Such a range may be, for example, between 100 to 1,000 millimeters of adjustment range.

Figure 8:
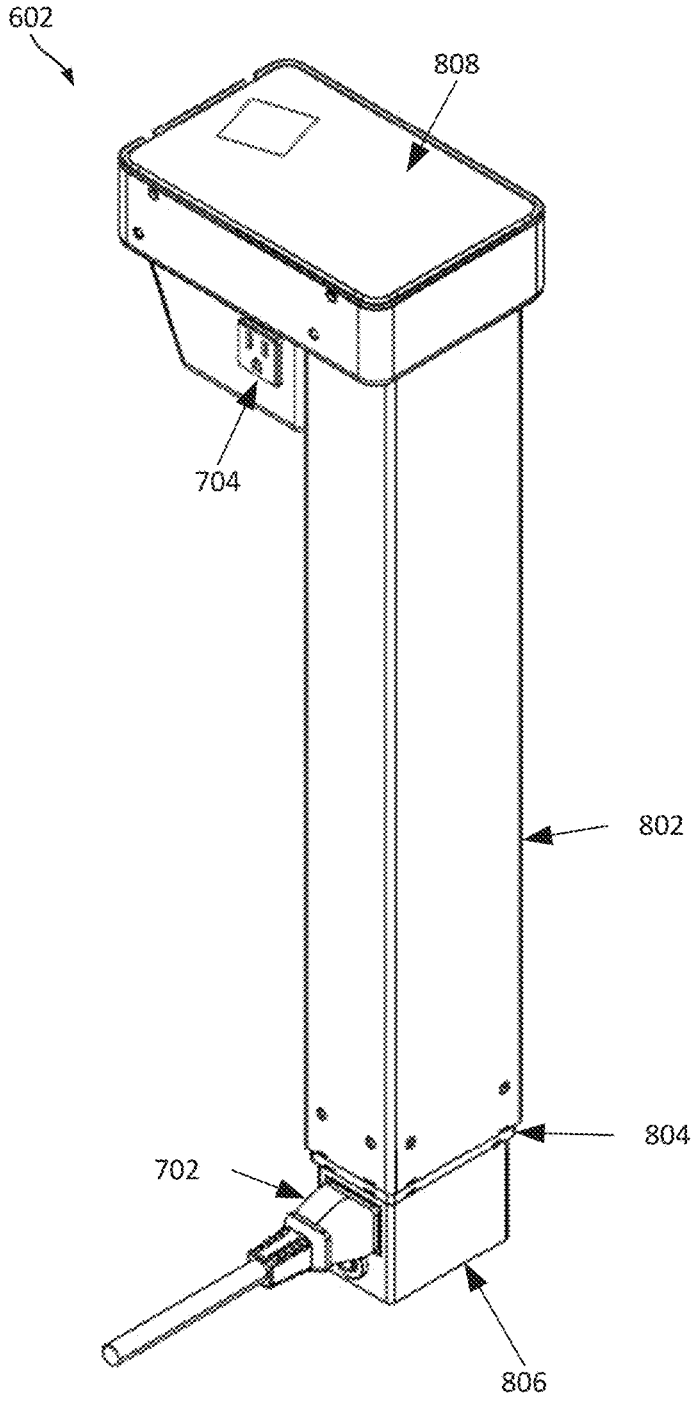
FIGS. 8-16 illustrate features of a lifting leg of the lifting table, in accordance with certain embodiments.

FIGS. 8-16 illustrate features of a lifting leg of the lifting table, in accordance with certain embodiments. FIG. 8 illustrates leg 602, which includes power port 702, power port 704, outer leg 802, middle leg 804, inner leg 806, and motor portion 808. In various embodiments, leg 602 may be a lifting leg that is configured to extend and/or retract in a telescoping manner. In order to provide additional stability and greater height adjustability, leg 602 may telescope through three leg portions. Outer leg 802 may be partially enclosed by middle leg 804 while middle leg 804 may be partially enclosed by inner leg 806.

Motor portion 808 may include a motor that is coupled to outer leg 802, middle leg 804, and inner leg 806 and configured to provide motive power to extend or retract leg 602 via telescoping of outer leg 802, middle leg 804, and/or inner leg 806. Such a motor may be an electric motor or other type of motor and may transmit torque produced by the motor in any technique, such as via gear drive, belt drive, chain drive, piezoelectric devices, and/or another such technique. Motor portion 808 may be a container configured to house such a motor in a manner that is hidden away from the sight of a user when the table is assembled. Outer leg 802, middle leg 804, and inner leg 806 may be configured to move independent of movements of each motor or and/or may be configured to move in concert with each other.

In various embodiments, outer legs, middle legs, inner legs, and/or other such components may each be referred to as "leg elements." For such embodiments, at least a portion of one or more leg elements (e.g., inner leg 806 and/or middle leg 804) may be partially disposed within another of the leg elements.

Figure 9:
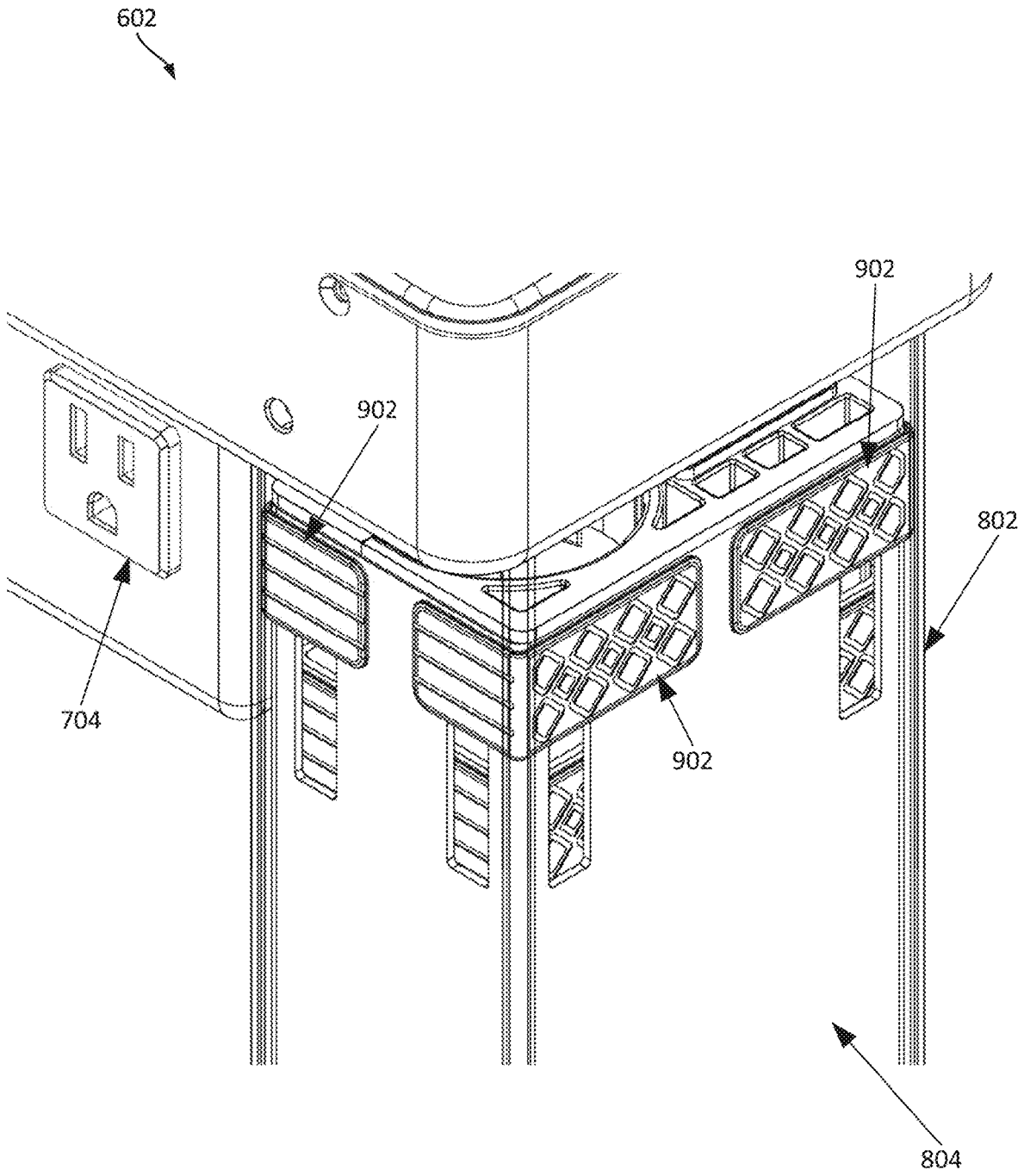

FIGS. 9-13 illustrate various aspects of the friction sliding plates within the legs that allow for the telescoping movement of the legs (e.g., movement of outer leg 802, middle leg 804, and inner leg 806 relative to each other). FIG. 9 illustrates friction sliding plate 902*s*, which is configured to decrease the friction between outer leg 802 (illustrated as a transparent object) and middle leg 804 to allow for relative movement between outer leg 802 and middle leg 804. Friction sliding plate 902 may be L-shaped friction plates disposed between outer leg 802 and middle leg 804 and coupled to certain portions of friction sliding plate 902 or 904 via, for example, slots, rivets, screws, and/or other such attachment features. Outer leg 802, middle leg 804, and inner leg 806 may be rectangular, circular, oval, triangular, or another shape (including any regular or irregular shapes) in cross-section and L-shaped friction sliding plate 902 may be configured to be disposed around or within a corner of outer leg 802 and/or middle leg 804. It is appreciated that, for the purposes of this disclosure, the angle of the "L-shape" is any possible angle and is not limited to, but may include, angles such as 30, 45, 60, 90, 120, 135, or 150 degree angles.

Figure 10:
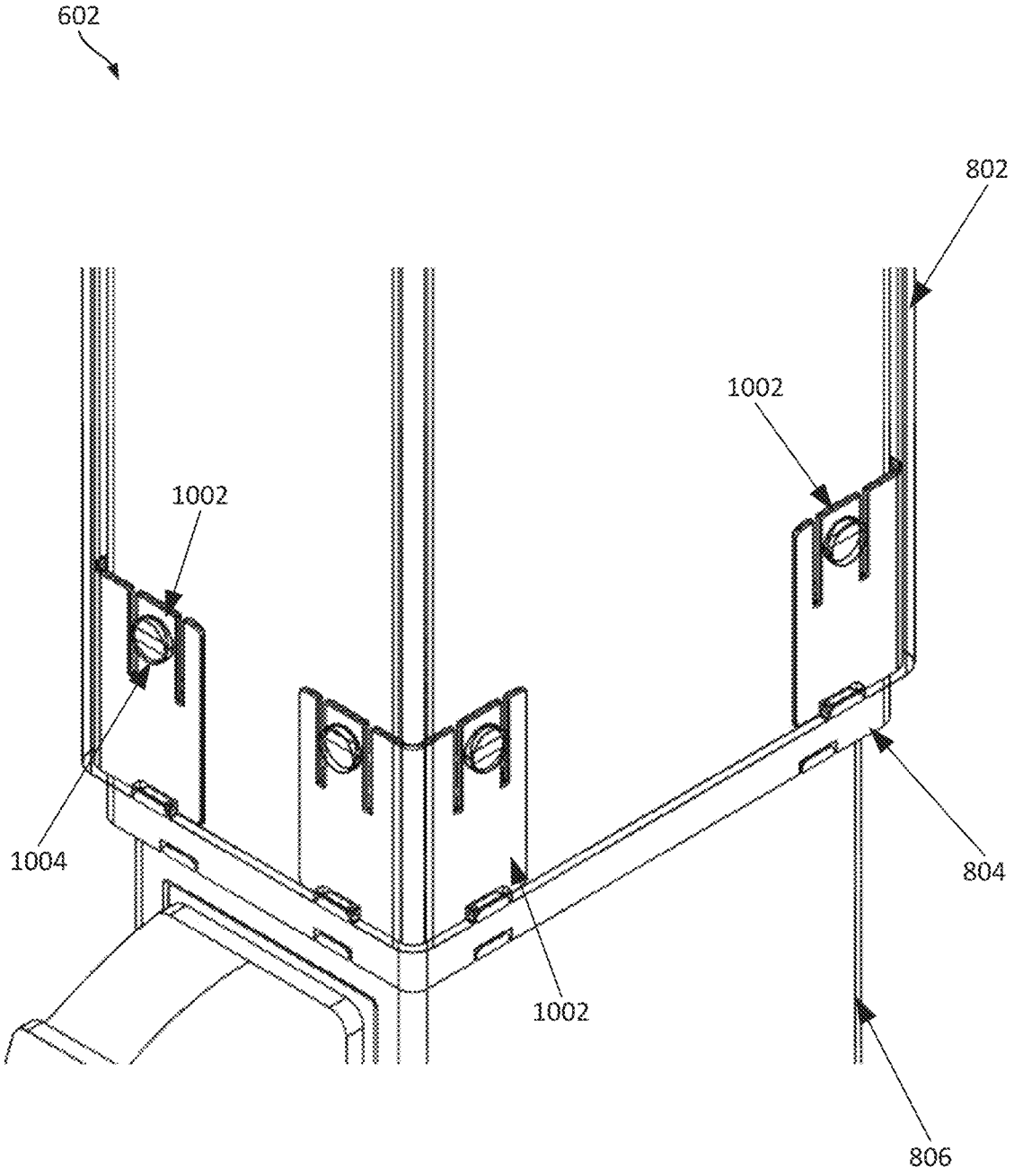

FIG. 10 illustrates friction sliding plate 1002*s*, which are L-shaped friction plates similar in configuration to that of friction sliding plate 902. In certain embodiments, friction sliding plate 902 may be coupled to middle leg 804 to move in concert with middle leg 804 while friction sliding plate 1002 may be coupled to outer leg 802 (illustrated as a transparent object) to move in concert with outer leg 802. As shown in FIG. 10, friction sliding plate 1002 may be attached to middle leg 804 via fastener 1004. Fastener 1004 may be a rivet, screw, or other fastener. Other embodiments may attach friction plates via other techniques.

Figure 11:
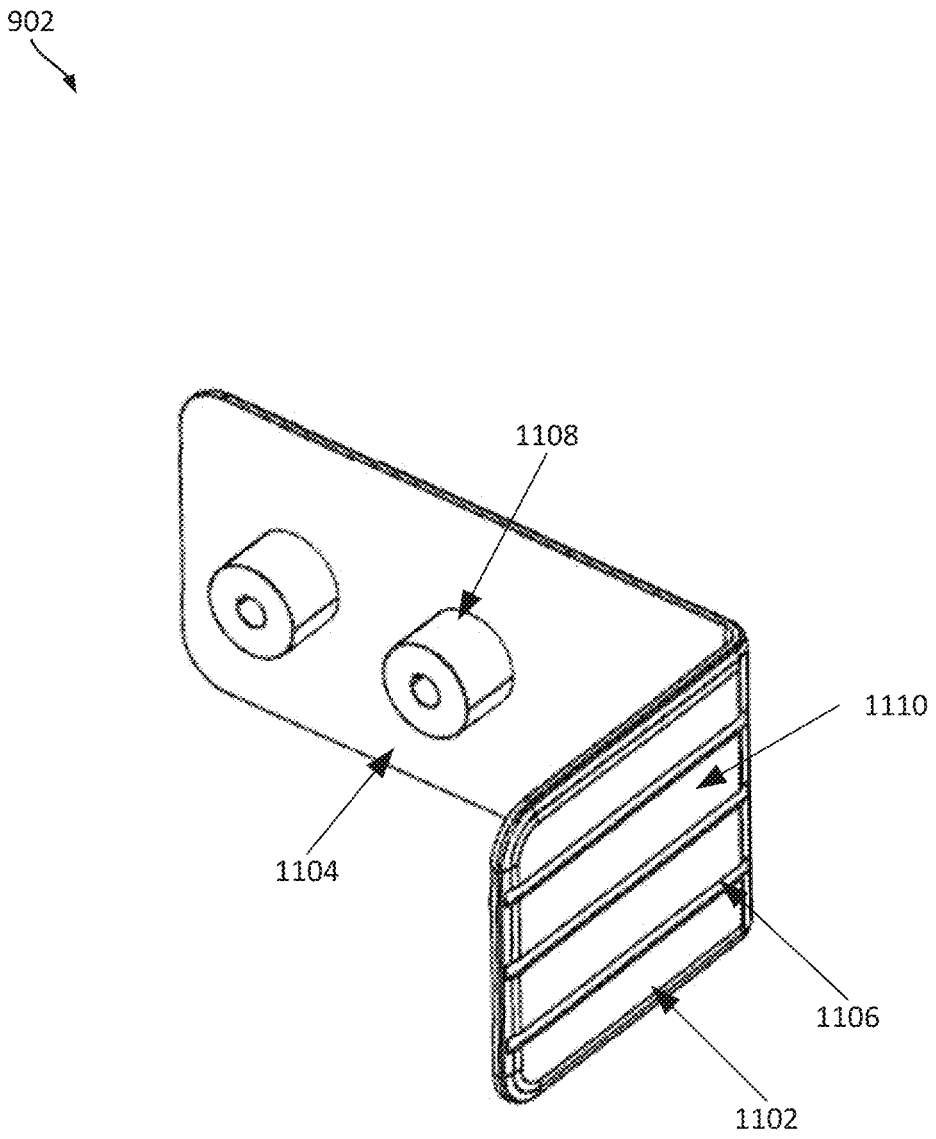

FIG. 11 illustrates features of friction sliding plate 902. friction sliding plate 902 may include first side 1102 and second side 1104. Second side 1104 may be coupled to the leg that friction sliding plate 902 moves in concert with while first side 1102 may slide relative to the other leg. Accordingly, second side 1104 may include fastener receiver 1108 configured to receive one or more fasteners that hold second side 1104 to the leg that it moves in concert with. Other embodiments may couple friction sliding plate 902 to such a leg in another manner.

First side 1102 may include groove 1106 and sliding surface 1110. Groove 1106 may be one or more grooves within first side 1102 that are configured to store lubricant and prevent lubricant from spilling outside of friction sliding plate 902. In certain embodiments, friction sliding plate 902 may include a seal around its perimeter to further capture the lubricant. The lubricant provides lubrication to sliding surface 1110 for sliding surface 1110 to slide relative to the position of the face of the other leg. In various embodiments, the lubricant may be grease, oil, powder, and/or another such lubricant configured to decrease friction between friction sliding plate 902 and the corresponding other leg that it moves against. Thus, sliding surface 1110 may be positioned to be in contact with the other leg and/or separated by the thickness of the lubricant.

Friction sliding plate 902 may be L-shaped and configured to be disposed around and/or within a bend of a leg. In various embodiments, groove 1106 and sliding surface 1110 may be present around both sides of the bend of friction sliding plate 902 to provide for an even sliding surface. The L-shape of friction sliding plate 902 may provide for greater stability when sliding, decreasing the chance of the legs from jamming into each other and providing for smoother telescoping operation between the legs.

Figure 12:
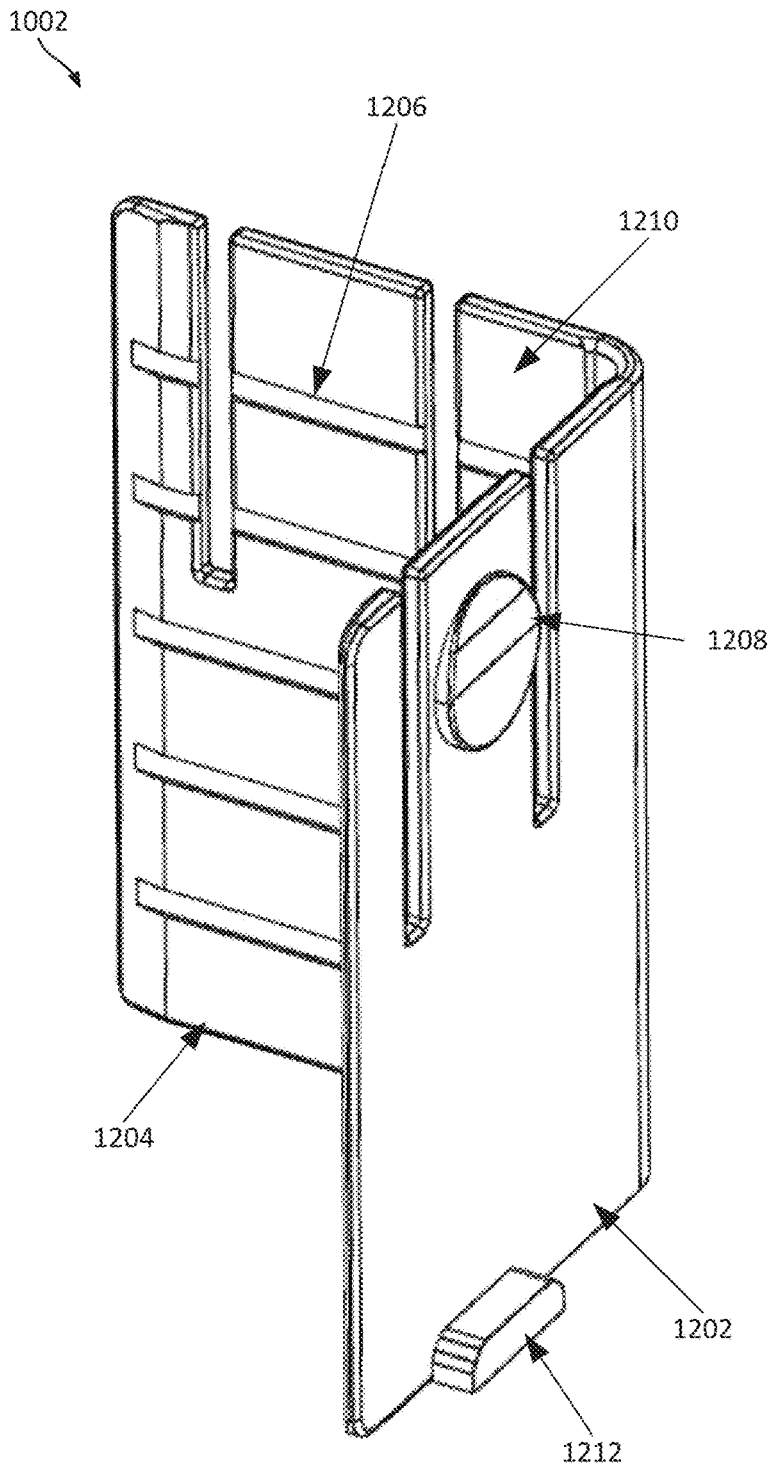

FIG. 12 illustrates features of friction sliding plate 1002, which may be another L-shaped sliding plate. It is appreciated that, for the purposes of this disclosure, various features of friction sliding plate 1002 may be similar to that of friction sliding plate 902 and, thus, description may not be repeated in the interest of brevity. Such similar features of friction sliding plate 1002 may include ordinal indicators that have the same last two digits as the corresponding items of friction sliding plate 902.

Friction sliding plate 1002 includes first side 1202 and second side 1204. first side 1202 includes fastener 1208 and positioning feature 1212. Fastener 1208 may be an attachment feature such as a form that is configured to be inserted into a corresponding receiver within the corresponding leg. Fastener 1208 may help position friction sliding plate 1002 on the leg. Positioning feature 1212 may further aid in positioning of friction sliding plate 1002. Positioning feature 1212 may be a form configured to be disposed within a corresponding slot of the leg and orient and position friction sliding plate 1002 on the leg. Second side 1204 includes groove 1206 and sliding face 1210, which may be similar in configuration to other grooves and sliding surfaces described herein.

Figure 13:
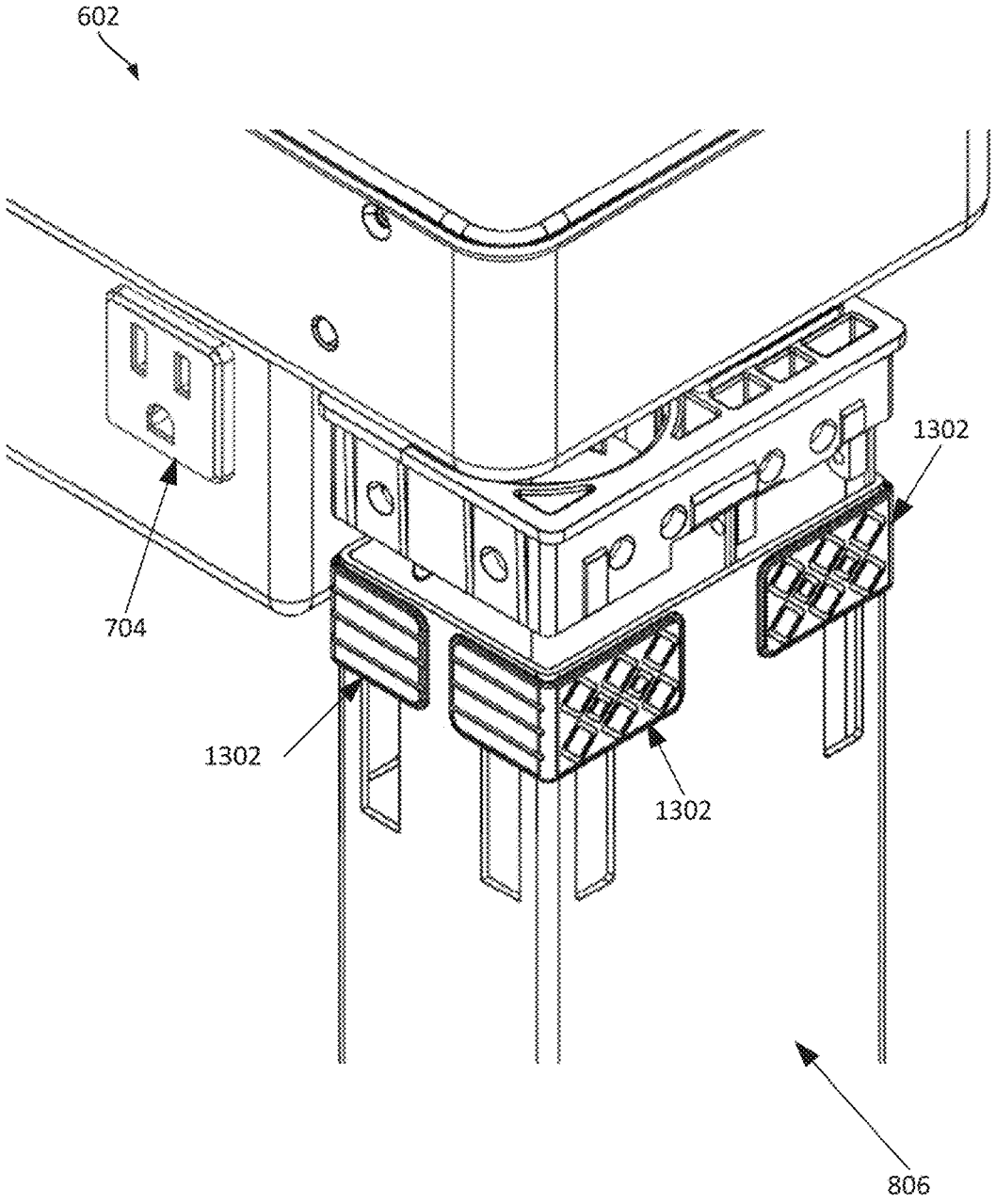

FIG. 13 illustrates friction sliding plate 1302*s*, which are L-shaped friction plates similar in configuration to that of friction sliding plate 902 and friction sliding plate 1002. While friction sliding plate 902 and friction sliding plate 1002 are configured to aid the movement of outer leg 802 relative to middle leg 804, friction sliding plate 1302 is configured to aid the movement of middle leg 804 (not shown in FIG. 13) relative to inner leg 806.

Figure 14:
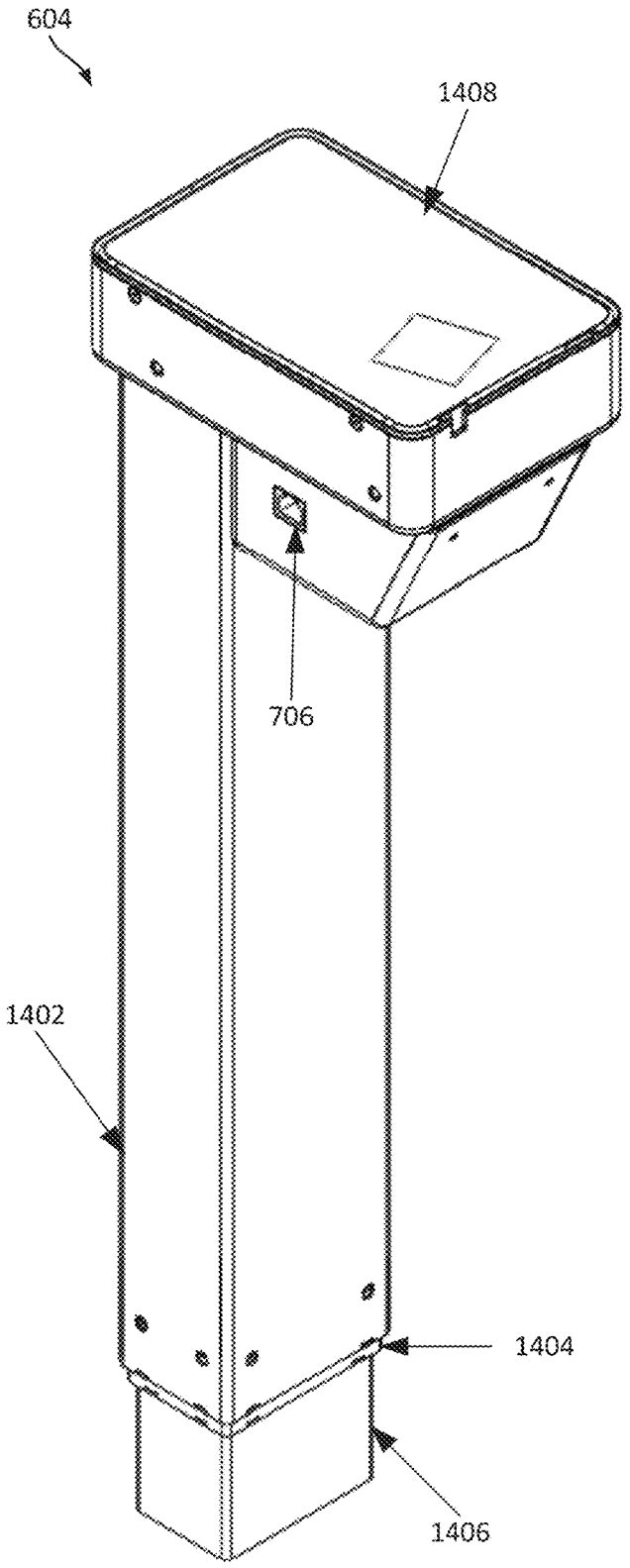
Figure 15:
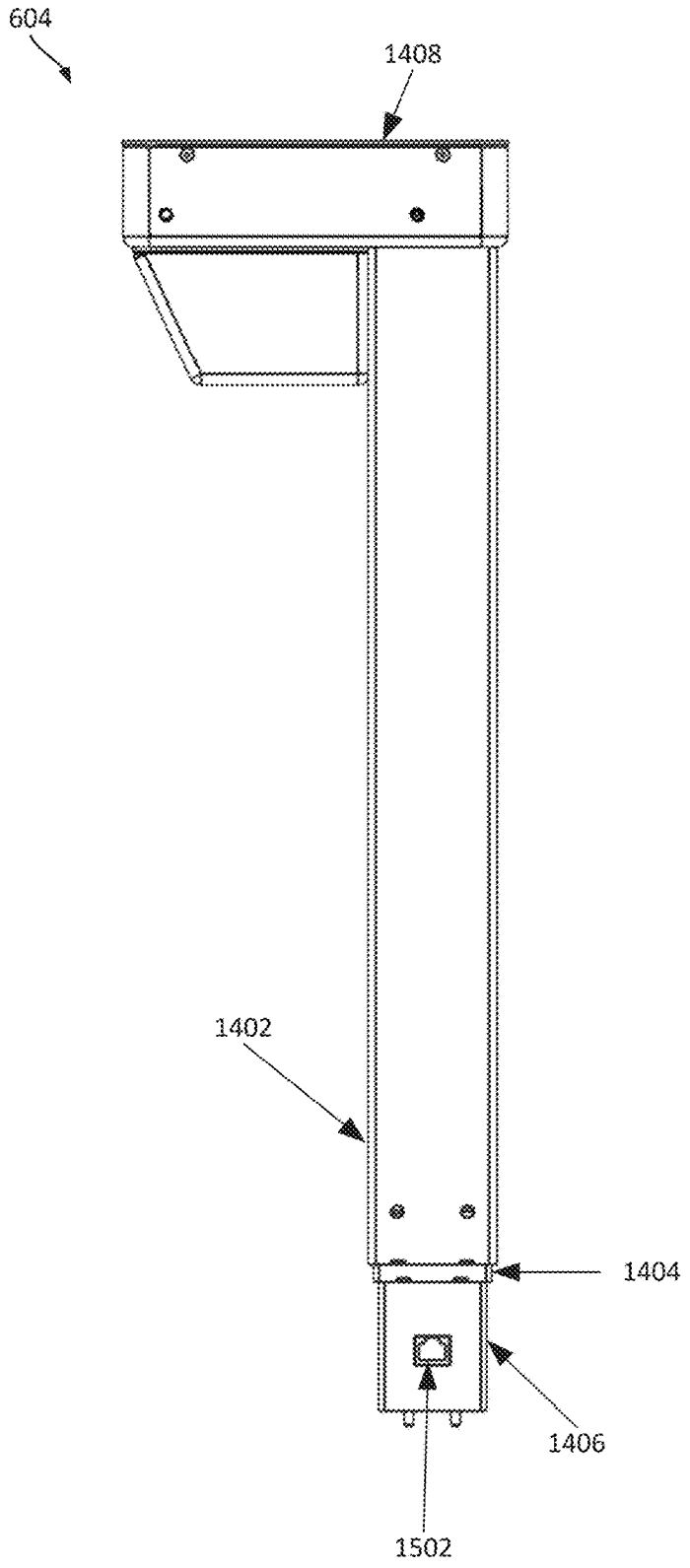
Figure 16:
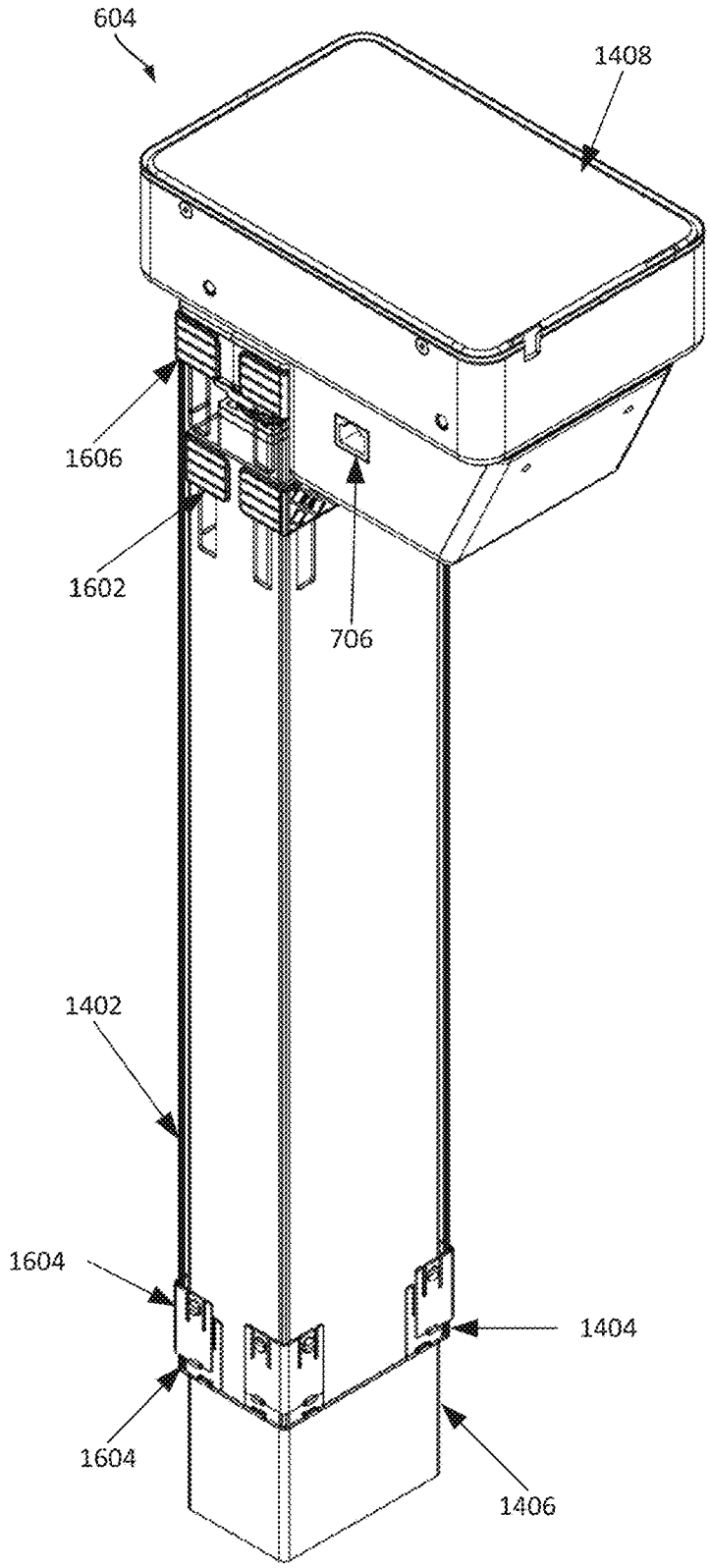

FIGS. 14-16 illustrate various additional features of leg 604. FIG. 14 illustrates that leg 604 includes a telescoping leg assembly that includes outer leg 1402, middle leg 1404, and inner leg 1406, according to the techniques described herein. Movement of outer leg 1402, middle leg 1404, and/or inner leg 1406 relative to each other may be via motor portion 1408, which may include a motor configured to provide motive power for such movement.

As shown in FIGS. 14 and 15, leg 604 may include data connection 706 and data connection 1502. Various embodiments may configure one of data connection 706 as an input and one of data connection 1502 as an output, both as inputs, both as outputs, and/or provide for independent data connections between data connection 706 and data connection 1502 (e.g., with inputs/outputs on another portion of table 600) or connected data connections between data connection 706 and data connection 1502.

FIG. 16 illustrates that movement of outer leg 1402, middle leg 1404, and/or inner leg 1406 relative to each other may be aided via friction sliding plate 1602, friction sliding plate 1604, and friction sliding plate 1606, as shown. Friction sliding plate 1602, friction sliding plate 1604, and friction sliding plate 1606 may be similar in configuration to other friction sliding plates as described herein.

Figure 17:
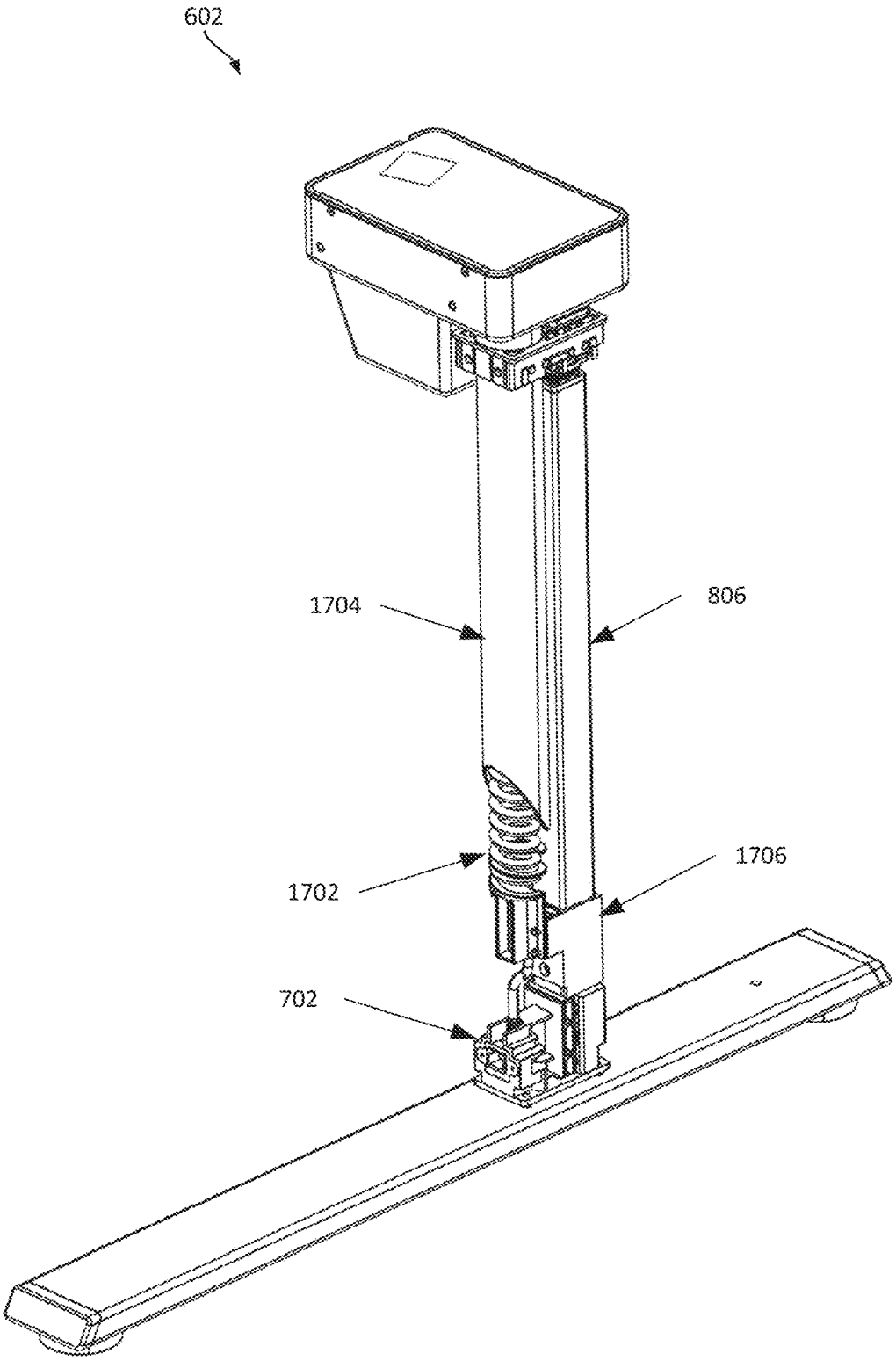
FIGS. 17 and 18 illustrate lifting features of a lifting leg, in accordance with certain embodiments.
Figure 18:
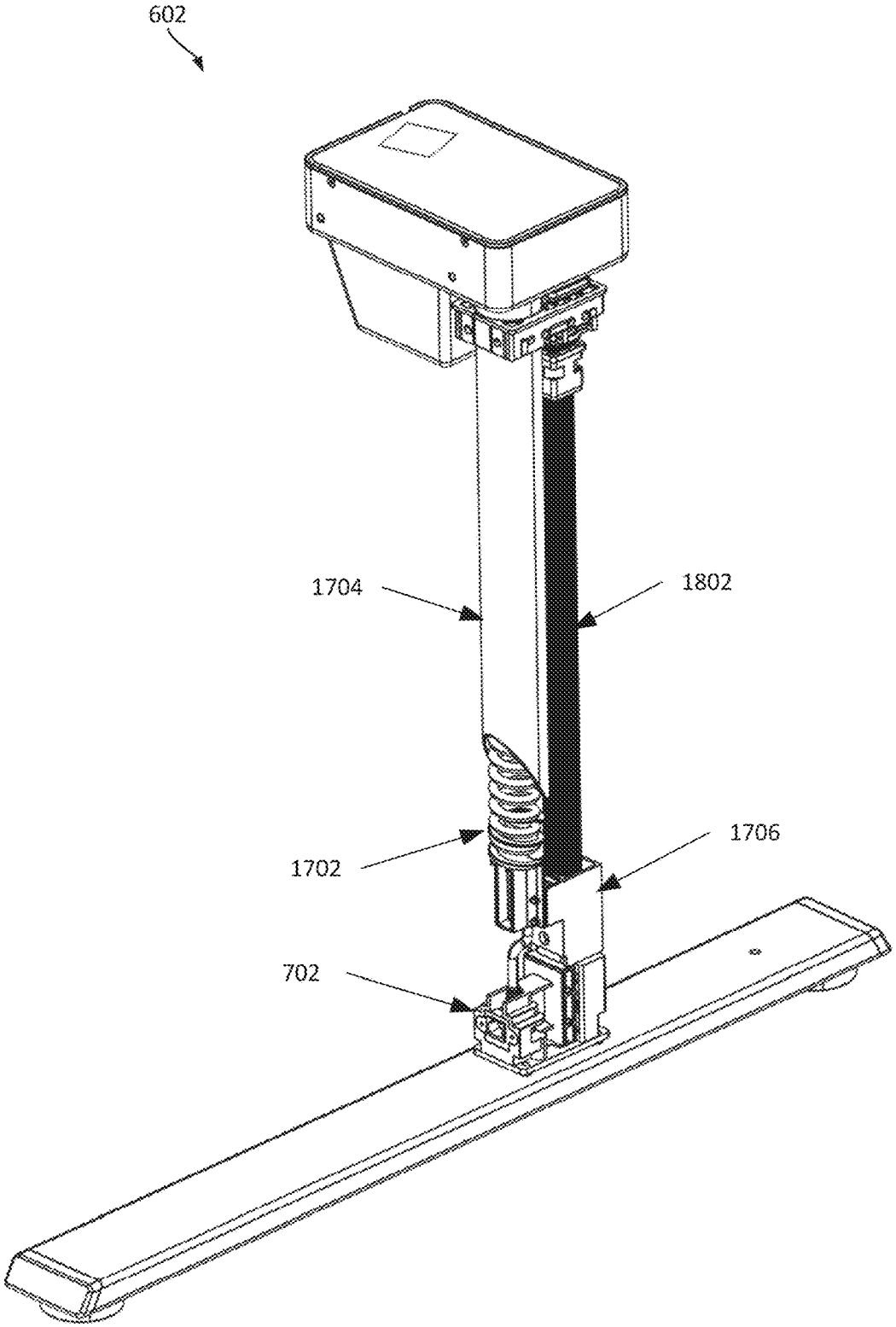

FIGS. 17 and 18 illustrate lifting features of a lifting leg, in accordance with certain embodiments. FIGS. 17 and 18 illustrate certain internal features of leg 602. The height of leg 602 may be adjusted via lifting leg screw 1802 screwing into lifting leg base 1706, as shown in FIG. 18. In various embodiments, lifting leg screw 1802 and lifting leg base 1706 may be collectively referred to as a lifting mechanism. In certain embodiments, lifting leg screw 1802 may be a screw rod configured to screw into a threaded portion of lifting leg base 1706. Rotating lifting leg screw 1802 into lifting leg base 1706 (e.g., via power provided by motor portion 808) may cause outer leg 802, middle leg 804, and/or inner leg 806 to telescope away from each other, lengthening leg 602. Rotating lifting leg screw 1802 in a direction out of lifting leg base 1706 may cause outer leg 802, middle leg 804, and/or inner leg 806 to collapse relative to each other and cause leg 602 to shorten. Thus, operation of lifting leg screw 1802 may change the position of inner leg 806 relative to middle leg 804 and/or outer leg 802.

Leg 602 includes shield 1704, which may be a shield of a fixed length that is disposed around cable 1702. Shield 1704 may be configured so that the length of shield 1704 is sufficient to provide shielding to cable 1702 when the length of leg 602 is adjusted. For example, shield 1704 provides protection to a portion of cable 1702 when lifting leg screw 1802 is rotating. Shield 1704 may be configured to provide such protection even when lifting leg screw 1802 is disposed in a configuration that provides for maximum height for leg 602. In various embodiments, cable 1702 may be a spirally wound cable that may be configured to substantially keep its outer diameter through a range of lengths.

Figure 19:
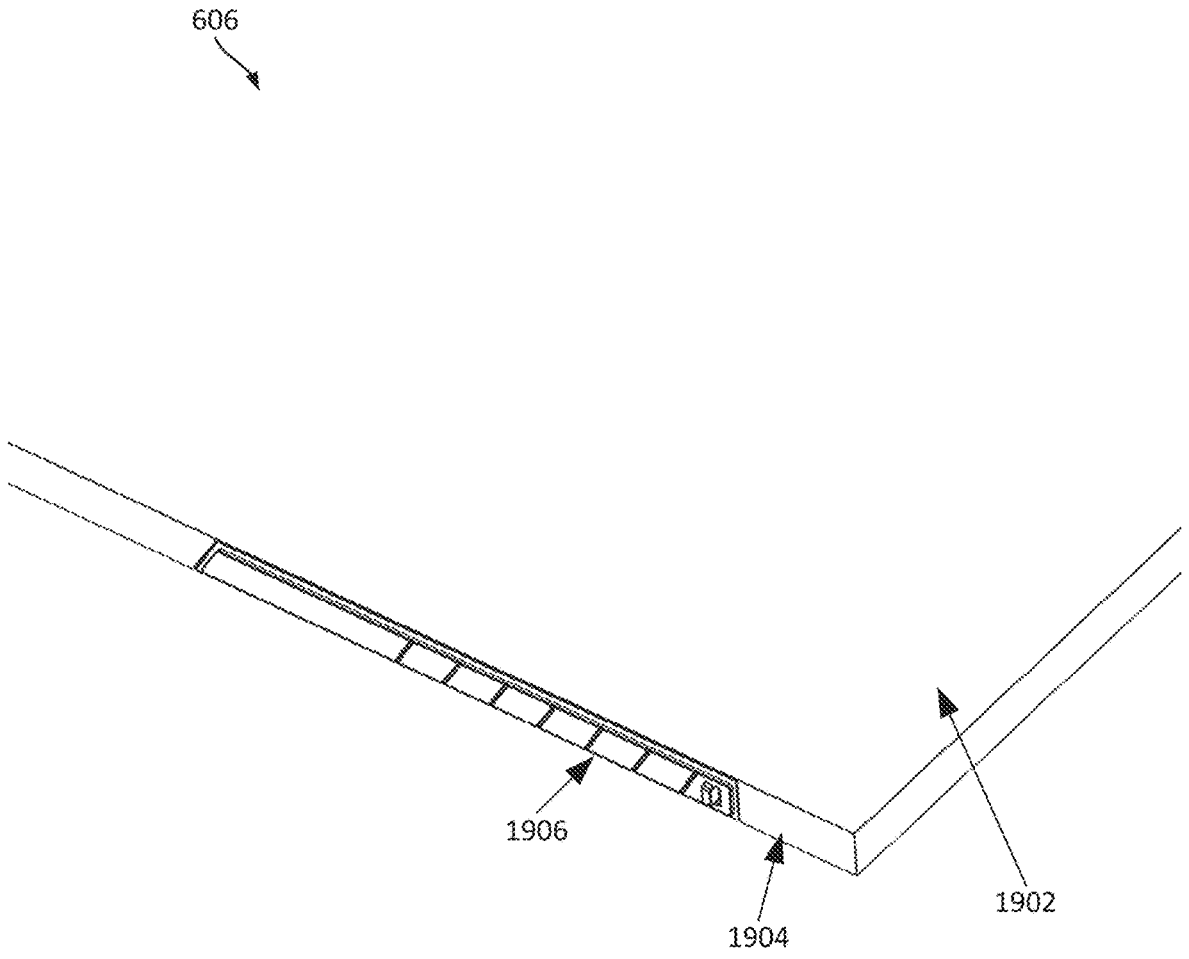
FIG. 19 illustrates features of a tabletop of a lifting table, in accordance with certain embodiments.

FIG. 19 illustrates features of a tabletop of a lifting table, in accordance with certain embodiments. FIG. 19 illustrates tabletop 606, which may include top surface 1902 and side surface 1904. controls 1906 may be disposed on side surface 1904 and may provide for an improved aesthetic compared to disposing of controls on top surface 1902.

Figure 20:
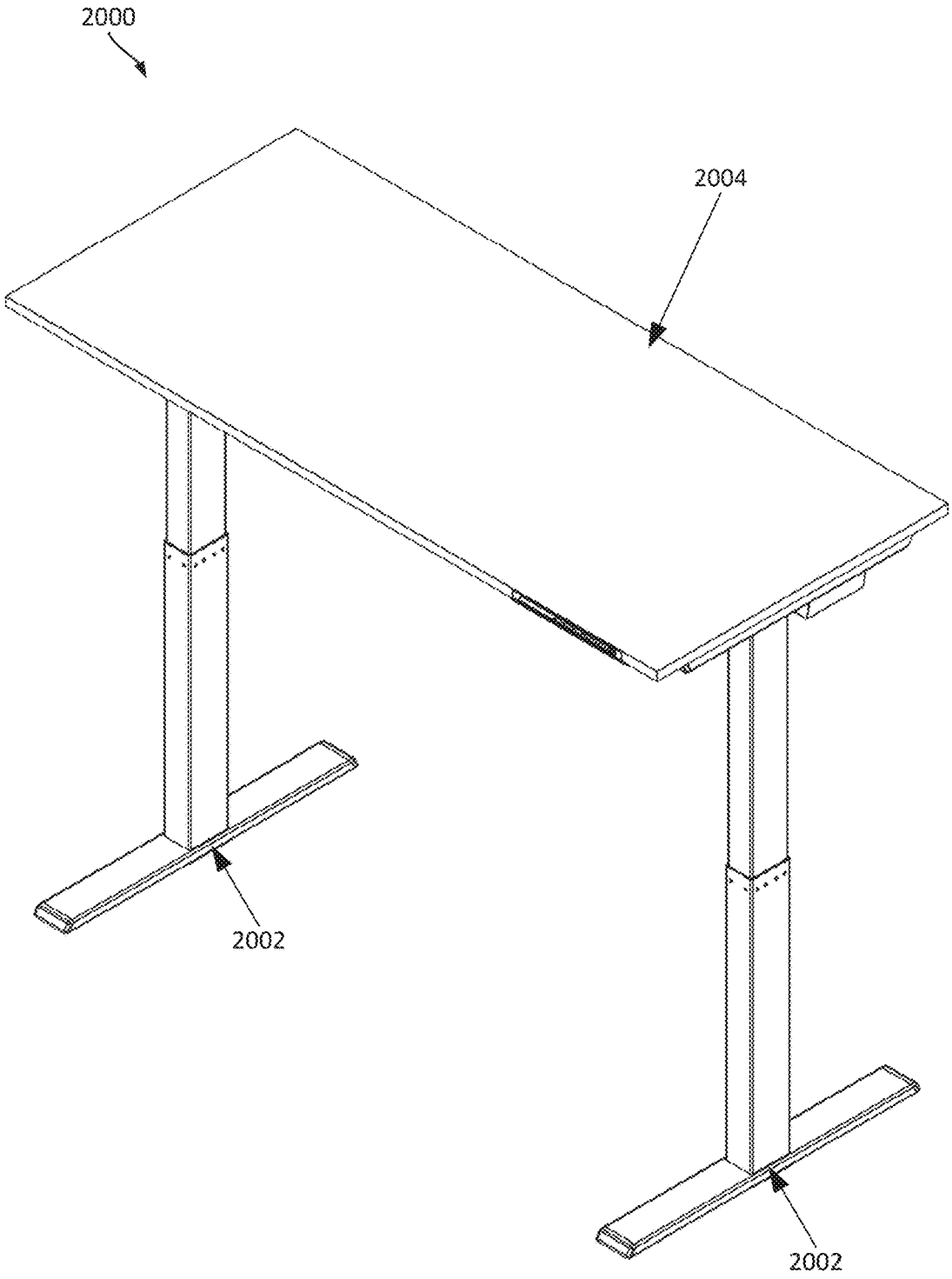
FIGS. 20 and 21 illustrate a further embodiment of a lifting table, in accordance with certain embodiments.
Figure 21:
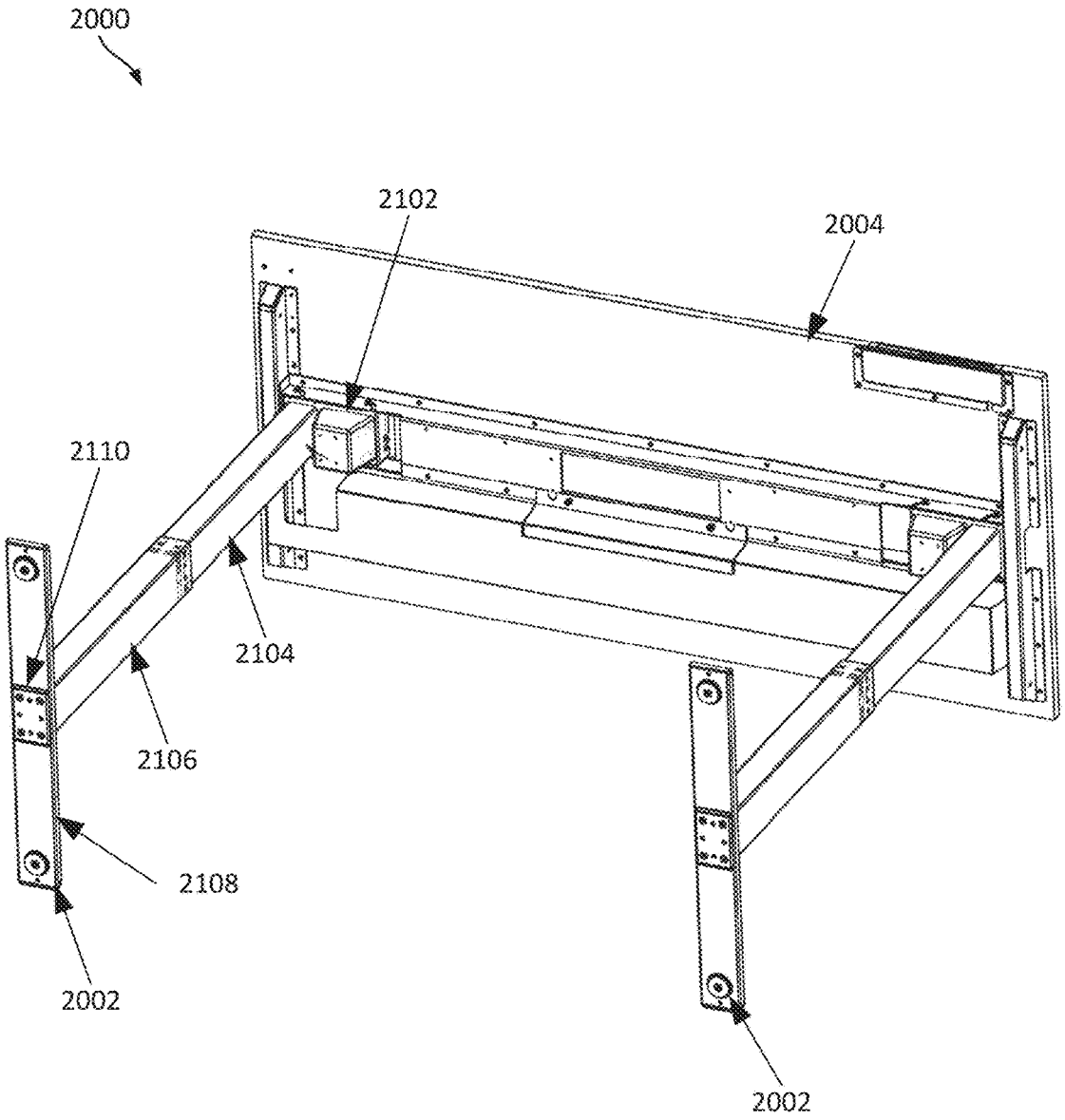

Table 2000, or features thereof, is illustrated in FIGS. 20-28. FIGS. 20 and 21 illustrate a further embodiment of a lifting table, in accordance with certain embodiments. Table 2000 includes tabletop 2004 and a plurality of leg 2002*s*. Each leg 2002 may include first leg portion 2104 and second leg portion 2106. First leg portion 2104 and second leg portion 2106 may be configured to move relative to each other via power provided by a motor of motor portion 2102. Leg 2002 may further include table foot 2108. Table foot 2108 may include depression 2110 that allows for a portion of second leg portion 2106 to be disposed sunken into depression 2110.

Figure 22:
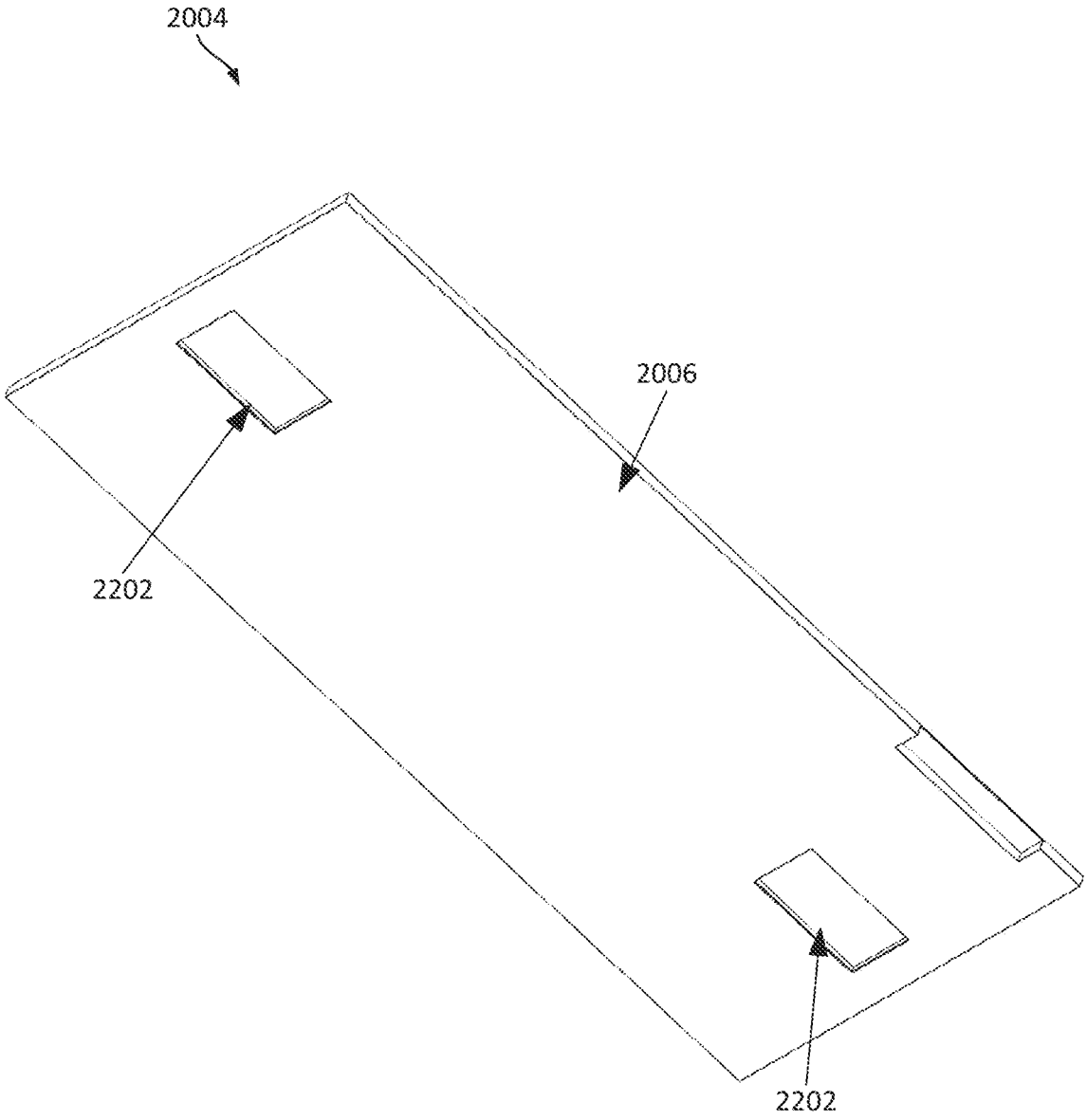
FIG. 22 illustrates features of a tabletop of a lifting table, in accordance with certain embodiments.
Figure 23:
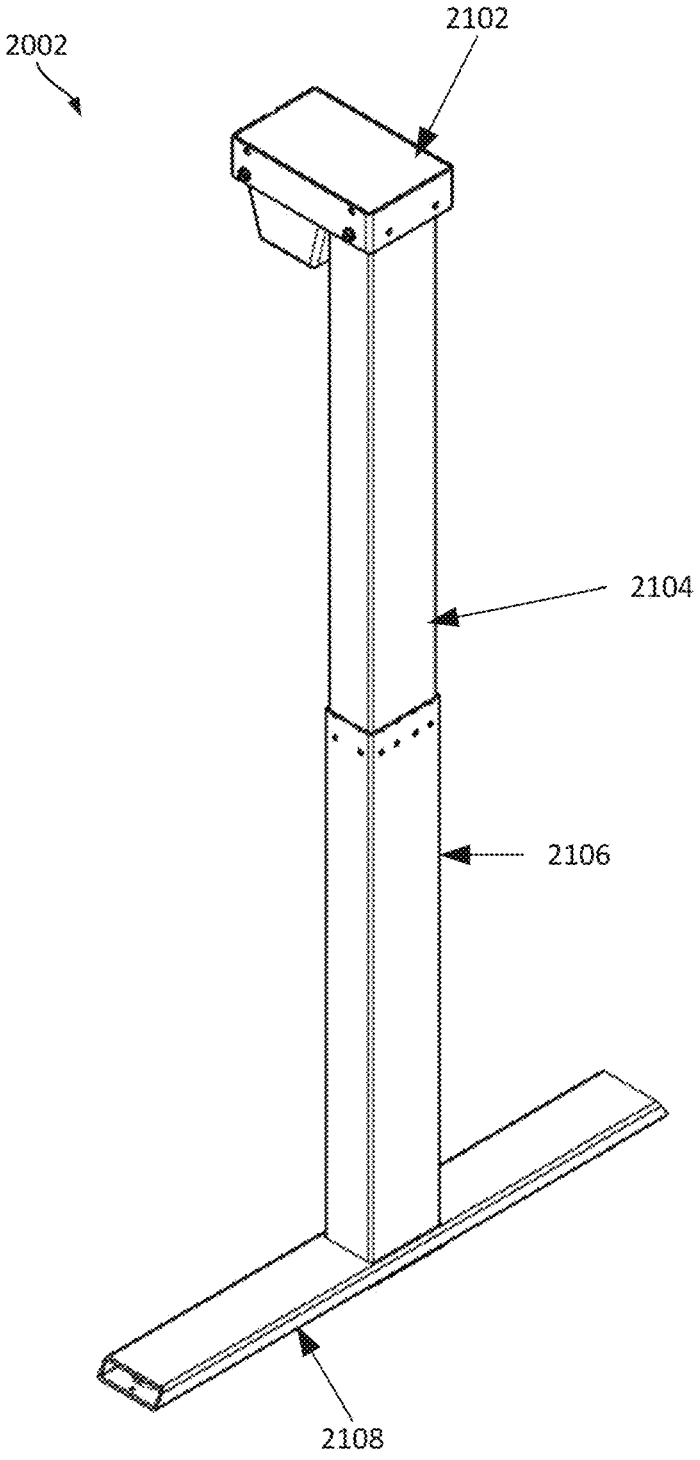
FIGS. 23-28 illustrate features of a lifting leg of the lifting table, in accordance with certain embodiments.

FIG. 22 illustrates features of a tabletop of a lifting table, in accordance with certain embodiments. FIG. 22 illustrates the underside of tabletop 2004. Tabletop 2004 includes cutout 2202*s* that are configured to receive a portion of motor portion 2102. Cutout 2202 may be one or more grooves cut into the bottom of tabletop 2004 to accommodate a portion of the height of motor portion 2102.

FIGS. 23-28 illustrate features of a lifting leg of the lifting table, in accordance with certain embodiments. FIGS. 23-28 illustrate various features of leg 2002. In certain view of FIGS. 23-28, certain elements of leg 2002 may not be shown in order to better illustrate certain features of leg 2002. Leg 2002 may include motor portion 2102, first leg portion 2104, second leg portion 2106, and table foot 2108, as described herein.

Figure 24:
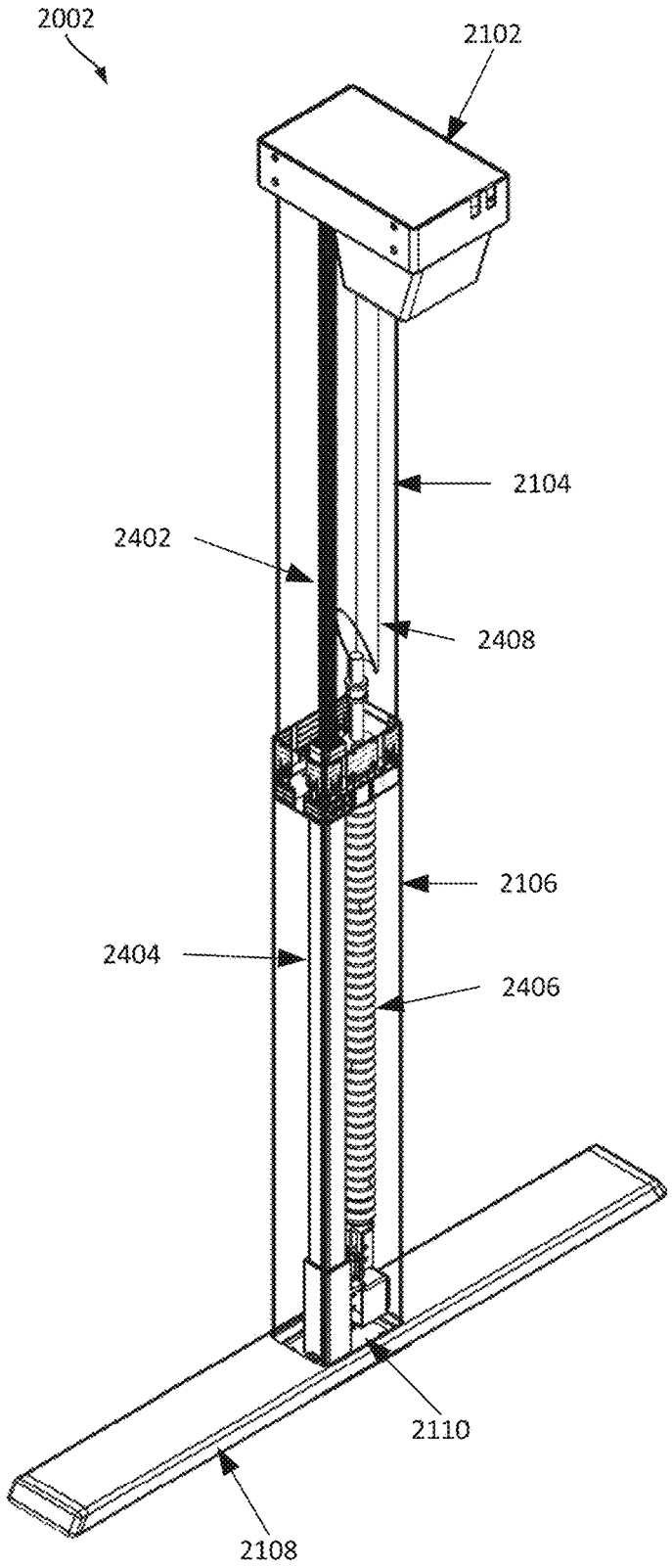

As shown in FIG. 24, lifting leg first portion 2402, lifting leg second portion 2404, cable 2406, and shield 2408 may be disposed within first leg portion 2104 and/or second leg portion 2106. Lifting leg first portion 2402 may be an adjustment screw and lifting leg second portion 2404 may include a threaded portion configured to receive lifting leg first portion 2402 and allow for lifting leg first portion 2402 to be screwed into the threaded portion to allow for changes in the length of leg 2002 by moving first leg portion 2104 relative to second leg portion 2106. Thus, lifting leg first portion 2402 may be coupled to first leg portion 2104 via motor portion 2102 and lifting leg second portion 2404 may be coupled to second leg portion 2106 (e.g., via table foot 2108).

Shield 2408 may be a shield disposed around a portion of cable 2406. Cable 2406 may be a data or power cable, as described herein. In certain embodiments, cable 2406 may be a spirally wound cable and shield 2408 may be configured to prevent contact between cable 2406 and lifting leg first portion 2402.

Figure 25:
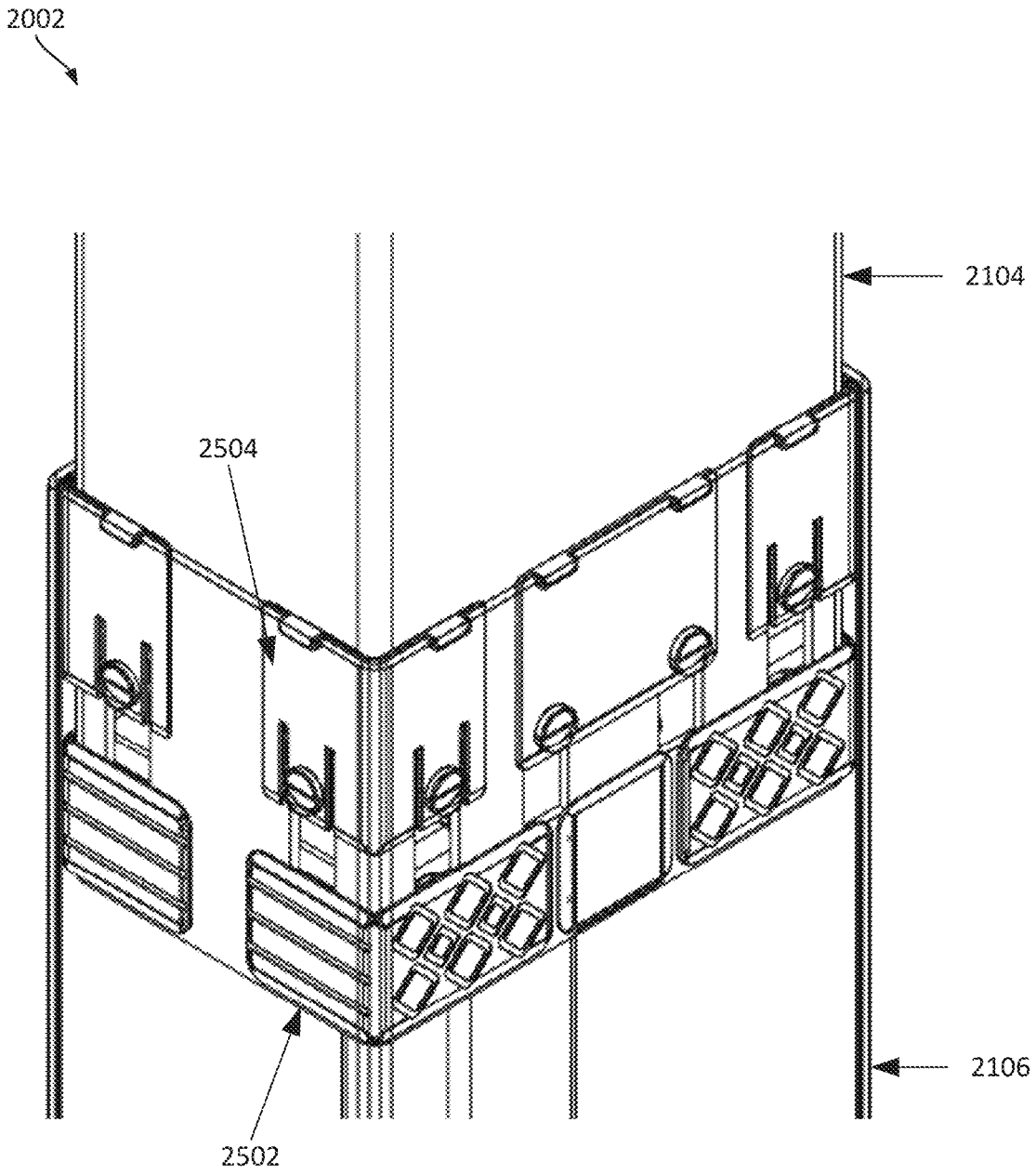

FIG. 25 illustrates friction sliding plate 2502 (which may be coupled to first leg portion 2104) and friction sliding plate 2504 (which may be coupled to second leg portion 2106). Friction sliding plate 2502 and friction sliding plate 2504 may be friction sliding plates similar to the friction sliding plates described herein. Thus, friction sliding plate 2502 and friction sliding plate 2504 may each include grooves for retention of lubricant and/or sliding surfaces, as described herein, to allow for relative movement between first leg portion 2104 and second leg portion 2106.

Figure 26:
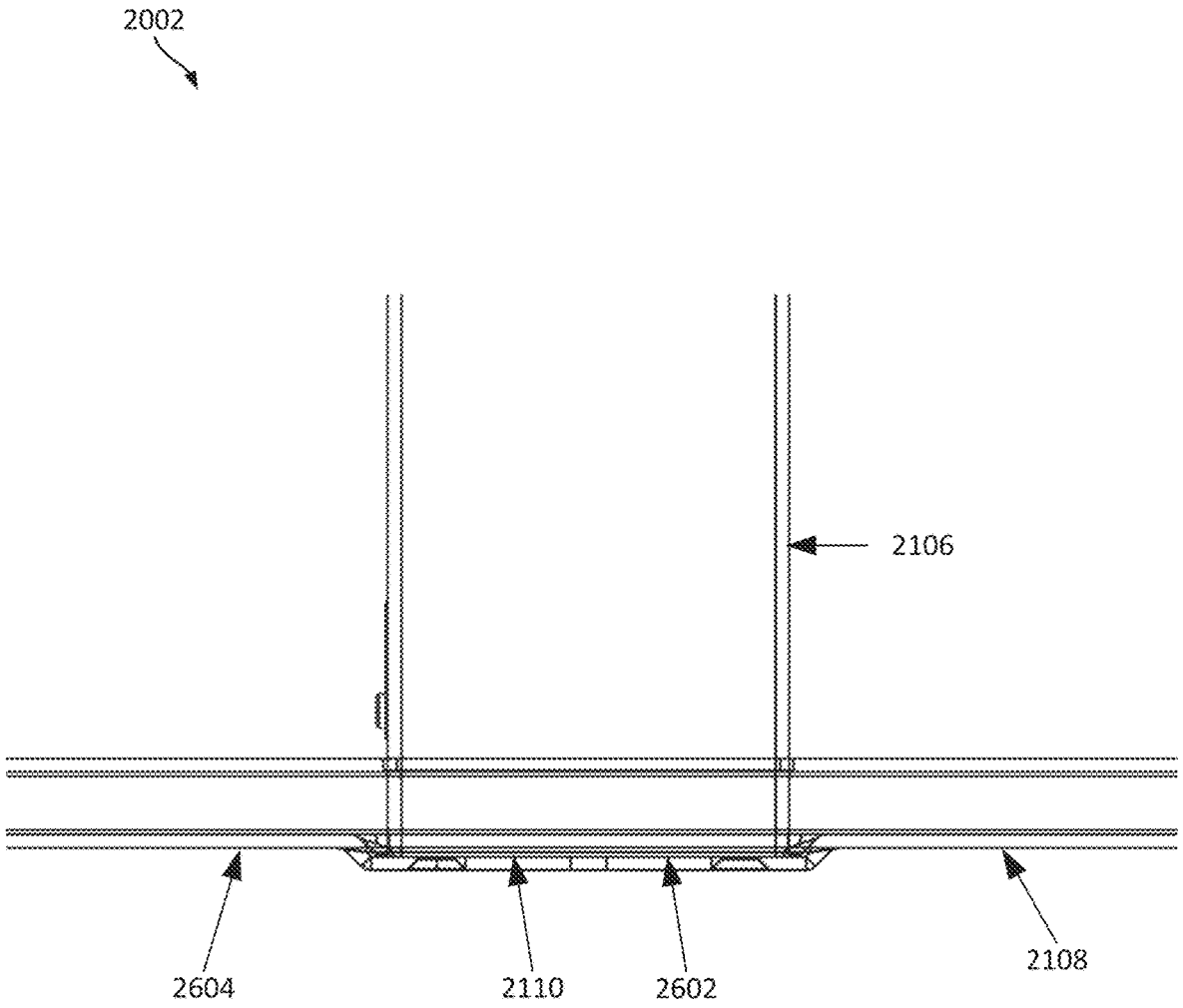

FIG. 26 illustrates that table foot 2108 includes foot bottom surface 2604 and depression bottom surface 2602. As shown in FIG. 26, depression bottom surface 2602 is the bottom surface of depression 2110. Depression bottom surface 2602 may be disposed lower (e.g., closer to the ground) than that of foot bottom surface 2604. Thus, a portion of second leg portion 2106 may be disposed within depression 2110, allowing for effective lowering of the length of leg 2002 for table 2000.

Figure 27:
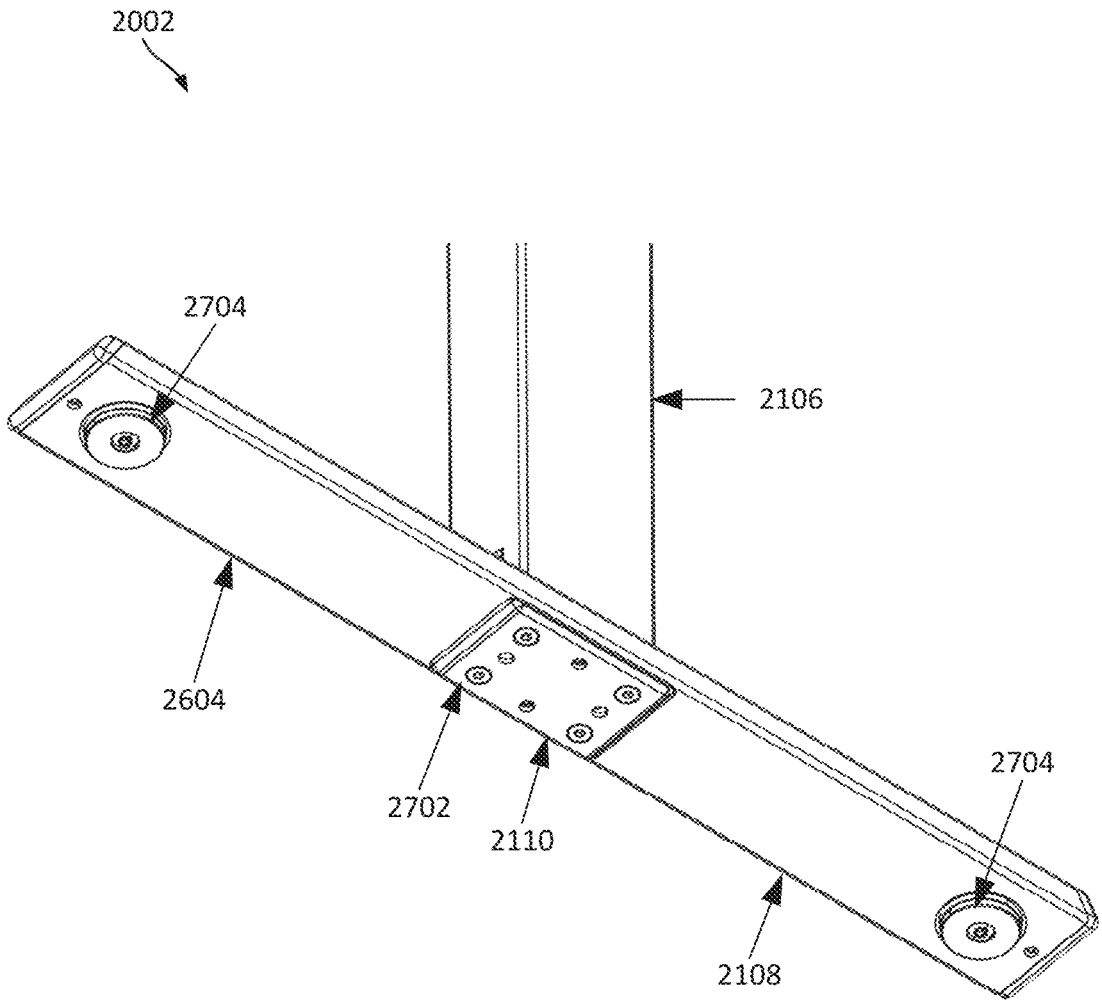
Figure 28:
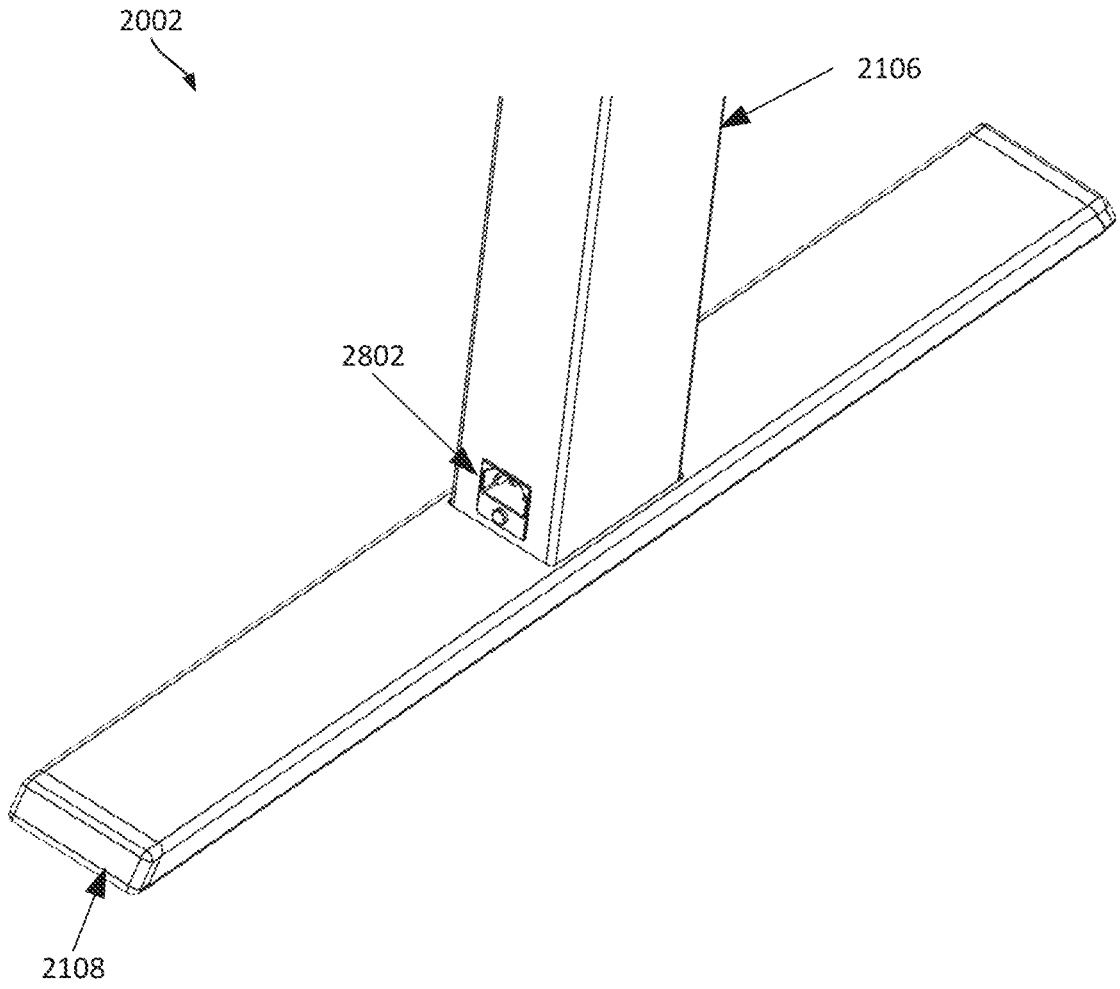

As shown in FIG. 27, second leg portion 2106 may be coupled to table foot 2108 via fastener 2702, which may be any type of fastener that allows for a permanent, semi-permanent, or removable coupling between second leg portion 2106 and table foot 2108, such as screws and/or bolts. Table foot 2108 may further include foot stand 2704, which may be stands to concentrate contact between the floor and table foot 2108 on foot stand 2704, to prevent damage to the floor surface. Furthermore, second leg portion 2106 may include port 2802, which may be any type of power or data connection as described herein.

CONCLUSION

In the foregoing specification, various techniques and mechanisms may have been described in singular form for clarity. However, it should be noted that some embodiments include multiple iterations of a technique or multiple instantiations of a mechanism unless otherwise noted. Similarly, various techniques and mechanisms may have been described as including a connection between two entities. However, a connection does not necessarily mean a direct, unimpeded connection, as a variety of other entities may reside between the two entities.

In the foregoing specification, reference was made in detail to specific embodiments including one or more of the best modes contemplated by the inventors. While various implementations have been described herein, it should be understood that they have been presented by way of example only, and not limitation. For example, some techniques and mechanisms are described herein in the context of working or gaming desks. However, the techniques of the present invention apply to a wide variety of tables. Particular embodiments may be implemented without some or all of the specific details described herein. In other instances, well known process operations have not been described in detail in order not to unnecessarily obscure the present invention. Accordingly, the breadth and scope of the present application should not be limited by any of the implementations described herein, but should be defined only in accordance with the claims and their equivalents.

The invention claimed is:

1. A lifting table comprising:
a tabletop; and
a lifting leg, coupled to the tabletop and configured to dispose the tabletop within a plurality of different heights, the lifting leg comprising:
an outer leg; and
a lift mechanism, at least partially disposed within the outer leg, the lift mechanism comprising:
a screwblock, comprising a threaded portion and an angled tongue;
an adjustment screw, threaded into the threaded portion of the screwblock and configured to move a position of the screwblock relative to the outer leg when the adjustment screw is rotated; and
a table foot, comprising an angled groove, coupled to the screwblock and configured to move vertically in response to movement of the screwblock, wherein the angled tongue is disposed within the angled groove.

2. The lifting table of claim 1, wherein the angled tongue and angled groove are angled to move the position of the screwblock relative to the outer leg when the adjustment screw is rotated.

3. The lifting table of claim 1, wherein moving the position of the screwblock relative to the outer leg changes a position of the table foot relative to the outer leg.

4. The lifting table of claim 1, wherein the adjustment screw is captive to the outer leg.

5. The lifting table of claim 1, wherein adjustment screw comprises a first end comprising a screwhead and a second end opposite the first end, and wherein the lift mechanism further comprises:
a disc spring disposed proximate the second end and configured to provide a spring force against the screwblock when the screwblock is disposed proximate the second end.

6. A lifting table comprising:
a tabletop; and
a lifting leg, coupled to the tabletop and configured to dispose the tabletop within a plurality of different heights, the lifting leg comprising:
an outer leg; and
a lift mechanism, at least partially disposed within the outer leg, the lift mechanism comprising:
a screwblock, comprising a threaded portion and an angled groove;
an adjustment screw, threaded into the threaded portion of the screwblock and configured to move a position of the screwblock relative to the outer leg when the adjustment screw is rotated; and
a table foot, comprising an angled tongue, coupled to the screwblock and configured to move vertically in response to movement of the screwblock, wherein the angled tongue is disposed within the angled groove.

7. The lifting table of claim 6, wherein the angled tongue and angled groove are angled to move the position of the screwblock relative to the outer leg when the adjustment screw is rotated.

8. The lifting table of claim 6, wherein moving the position of the screwblock relative to the outer leg changes a position of the table foot relative to the outer leg.

9. The lifting table of claim 6, wherein the adjustment screw is captive to the outer leg.

10. The lifting table of claim 6, wherein adjustment screw comprises a first end comprising a screwhead and a second end opposite the first end, and wherein the lift mechanism further comprises:

a disc spring disposed proximate the second end and configured to provide a spring force against the screwblock when the screwblock is disposed proximate the second end.

11. A lifting table comprising:

a tabletop; and a lifting leg, coupled to the tabletop and configured to dispose the tabletop within a plurality of different heights, the lifting leg comprising:

an outer leg; and a lift mechanism, at least partially disposed within the outer leg, the lift mechanism comprising:

a screwblock, comprising a threaded portion;

an adjustment screw, threaded into the threaded portion of the screwblock and configured to move a position of the screwblock relative to the outer leg when the adjustment screw is rotated, wherein the adjustment screw is captive to the outer leg; and a table foot, coupled to the screwblock and configured to move vertically in response to movement of the screwblock.

12. The lifting table of claim 11, wherein the screwblock comprises an angled tongue and the table foot comprises an angled groove, and wherein the angled tongue is disposed within the angled groove.

13. The lifting table of claim 12, wherein the angled tongue and angled groove are angled to move the position of the screwblock relative to the outer leg when the adjustment screw is rotated.

14. The lifting table of claim 11, wherein moving the position of the screwblock relative to the outer leg changes a position of the table foot relative to the outer leg.

15. The lifting table of claim 11, wherein adjustment screw comprises a first end comprising a screwhead and a second end opposite the first end, and wherein the lift mechanism further comprises:

a disc spring disposed proximate the second end and configured to provide a spring force against the screwblock when the screwblock is disposed proximate the second end.

16. The lifting table of claim 11, wherein the screwblock comprises an angled groove and the table foot comprises an angled tongue, and wherein the angled tongue is disposed within the angled groove.

* * * * *